US009139014B2

(12) United States Patent
Ito et al.

(10) Patent No.: US 9,139,014 B2
(45) Date of Patent: Sep. 22, 2015

(54) INKJET RECORDING APPARATUS

(71) Applicants: Tsuyoshi Ito, Nagoya (JP); Takashi Omura, Nagoya (JP); Yuki Matsui, Kiyosu (JP)

(72) Inventors: Tsuyoshi Ito, Nagoya (JP); Takashi Omura, Nagoya (JP); Yuki Matsui, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 12 days.

(21) Appl. No.: 13/853,121

(22) Filed: Mar. 29, 2013

(65) Prior Publication Data

US 2013/0278654 A1 Oct. 24, 2013

(30) Foreign Application Priority Data

Apr. 24, 2012 (JP) ..... 2012-098306

(51) Int. Cl.

| | |
|---|---|
| ***B41J 29/38*** | (2006.01) |
| ***B41J 2/175*** | (2006.01) |
| ***B41J 11/42*** | (2006.01) |
| ***B41J 13/00*** | (2006.01) |
| ***B41J 3/60*** | (2006.01) |
| ***B41J 11/00*** | (2006.01) |
| ***B41J 11/06*** | (2006.01) |

(52) U.S. Cl.

CPC ..... *B41J 2/17566* (2013.01); *B41J 3/60* (2013.01); *B41J 11/005* (2013.01); *B41J 11/006* (2013.01); *B41J 11/06* (2013.01); *B41J 11/42* (2013.01); *B41J 13/0009* (2013.01)

(58) Field of Classification Search

CPC .... B41J 11/42; B41J 13/0009; B41J 11/0015; B41J 11/0055; B41J 2/2114; B41J 29/393; B41J 13/00

See application file for complete search history.

(56) References Cited

U.S. PATENT DOCUMENTS

| | | | | |
|---|---|---|---|---|
| 7,997,676 | B2 | 8/2011 | Kawamata et al. | |
| 8,205,956 | B2 | 6/2012 | Kawamata et al. | |
| 2003/0048345 | A1 * | 3/2003 | Matsumoto | 347/104 |
| 2009/0085948 | A1 | 4/2009 | Kawamita et al. | |
| 2010/0156981 | A1 | 6/2010 | Chikuma et al. | |
| 2010/0207321 | A1 * | 8/2010 | Samoto et al. | 271/225 |
| 2011/0273524 | A1 | 11/2011 | Kawamata et al. | |

FOREIGN PATENT DOCUMENTS

| | | | |
|---|---|---|---|
| JP | 2009-083225 | A | 4/2009 |
| JP | 2010-162883 | A | 7/2010 |

* cited by examiner

*Primary Examiner* — Geoffrey Mruk
(74) *Attorney, Agent, or Firm* — Banner & Witcoff, Ltd.

(57) ABSTRACT

Conveyance of a sheet in an inkjet recording apparatus may be stopped under various conditions. In one example, a control device of the inkjet recording apparatus may stop conveyance on the sheet depending on the image to be formed in one or more portions of the sheet. Alternatively or additionally, conveyance may be stopped based on an amount of ink ejected or to be ejected onto a sheet, or portion thereof. The conveyance stoppage control may be used in conjunction with a corrugate mechanism in some arrangements.

26 Claims, 15 Drawing Sheets

INKJET RECORDING APPARATUS

CROSS-REFERENCE TO RELATED APPLICATION

This application claims priority from Japanese Patent Application No. 2012-098306, filed on Apr. 24, 2012, which is incorporated herein by reference in its entirety.

TECHNICAL FIELD

Aspects described herein relate to an inkjet recording apparatus that records an image onto a sheet by ejecting ink droplets onto the sheet.

BACKGROUND

A known inkjet recording apparatus records an image onto a sheet by ejecting ink droplets onto the sheet. The image recording by the inkjet recording apparatus is implemented by ejecting ink droplets toward the sheet from nozzles provided in a recording portion.

In the known inkjet recording apparatus, a problem, such as cockling, may occur. Cockling generally refers to deformation of a sheet in which ink droplets are absorbed, and the deformation causes curling or rippling in the sheet. When cockling occurs in the sheet, a distance (e.g., a head gap) between the sheet and the recording portion may vary during image recording. The head gap variations cause an undesired contact of the sheet with the recording portion or improper conveyance of the sheet in which a leading edge of the sheet is shifted from a desired position. These issues may lead to a paper jam in the known inkjet recording apparatus.

Another known image recording apparatus is configured to address the above-described problem and perform double-sided printing. After recording an image on one surface (e.g., a front surface) of a sheet, the other known image recording apparatus stops conveyance of the sheet in a U-shaped conveyance path for a predetermined time period before recording an image on the other surface (e.g., a back surface) of the sheet. By doing so, the sheet is intentionally curled in a substantially U-shape. When a curl direction that the sheet is intentionally curled is opposite to a curl direction that the sheet is curled due to the cockling, the curling caused intentionally and the curling caused by the cockling in the sheet compensate for each other. Therefore, the deformation of the sheet due to the cockling may be relieved.

SUMMARY

However, in the other known image recording apparatus, when the curl direction that the sheet is intentionally curled is the same as the curl direction that the sheet is curled due to the cockling, the curling in the sheet may get worse instead. In the sheet in which the cockling occurs, a location where the sheet is deformed or a direction that the sheet is deformed may vary depending on a location in which a large amount of ink droplets ejected onto the sheet. Therefore, in the other known image recording apparatus configured to curl a sheet intentionally in the U-shaped conveyance path, the curling caused by the cockling in the sheet may not be compensated accurately.

Accordingly, aspects of the disclosure are provided in view of the problem described above. For example, some embodiments of the disclosure provide for an inkjet recording apparatus that may reduce an occurrence of a paper jam caused by deformation of a sheet due to penetration of ink droplets in the sheet.

In one or more examples, an image recording apparatus may comprise a first conveyor, a support portion, a recording portion, a contact portion, and a control device. The first conveyor may be configured to convey the sheet in a conveyance direction. The support portion may comprise a plurality of protrusions spaced apart from each other with respect to a width direction perpendicular to the conveyance direction. The support portion may be disposed downstream of the first conveyor with respect to the conveyance direction and configured to support from below. The recording portion may be disposed opposingly above the support portion and configured to record an image onto the sheet supported by the support portion based on print data by ejecting ink droplets from nozzles. The contact portion may be disposed between a pair of protrusions of the plurality of protrusions with respect to the width direction and in a manner that the contact portion faces the support portion. The control device may be configured to determine, based pm the print date, a value related to an amount of ink needed to form an image, corresponding to the print date, on the sheet, determine, determine whether to stop conveyance of the sheet, in a state where the sheet faces the contact portion, based on the value, and stop the conveyance of the sheet in response to determining that the conveyance of the sheet is to be stopped.

In some examples, an image recording apparatus may comprise a conveyor, a support portion, a recording portion, a corrugate mechanism, and a control device. The conveyor may be configured to convey the sheet in a conveyance direction along the guide portion in a conveyance path. The support portion may be disposed downstream of the conveyor with respect to the conveyance direction and configured to support from below the sheet being conveyed in the conveyance path. The recording portion may be disposed opposingly above the support portion and configured to record an image onto the sheet supported by the support portion based on print data by ejecting ink droplets from nozzles. The corrugate mechanism may be configured to form a corrugated shape in the sheet. The control device may be configured to determine, based on the print data, a value related to an amount of ink needed to form an image, corresponding to the print data, on the sheet, determine whether to stop conveyance of the sheet, in a state where the sheet faces the corrugate mechanism, based on the value, and stop the conveyance of the sheet in response to determining that the conveyance of the sheet is to be stopped.

In other examples, an image recording apparatus may comprise a first conveyor, a support portion, a recording portion, a contact portion, and a control device. The first conveyor may be configured to convey a sheet in a conveyance direction. The support portion may comprising a plurality of protrusions spaced apart from each other with respect to a width direction perpendicular to the conveyance direction, wherein the support portion is may be disposed downstream of the first conveyor with respect to the conveyance direction and configured to support the sheet from below. The recording portion may be disposed opposingly above the support portion and configured to record an image onto the sheet supported by the support portion based on print data by ejecting ink droplets from nozzles. The contact portion may be disposed between a pair of protrusions of the plurality of protrusions with respect to a width direction and in a manner that the contact portion faces the support portion. The control device may be configured to determine whether to stop conveyance of the sheet, in a state where the sheet faces the contact portion, based on the image to be recorded corresponding to the print data, and stop the conveyance of the sheet in response to determining that the conveyance of the sheet is to be stopped.

According to the aspects of the disclosure, the corrugated shape formed in the sheet by the pressing of the contact portion may relieve deformation of the downstream end area of the sheet with respect to the conveyance direction. Thus, an occurrence of a paper jam caused by the deformation of the sheet due to absorption of ink droplets in the sheet may be reduced.

DESCRIPTION OF THE DRAWINGS

For a more complete understanding of the present disclosure, needs satisfied thereby, and the objects, features, and advantages thereof, reference now is made to the following descriptions taken in connection with the accompanying drawing.

DETAILED DESCRIPTION

Figure 1:
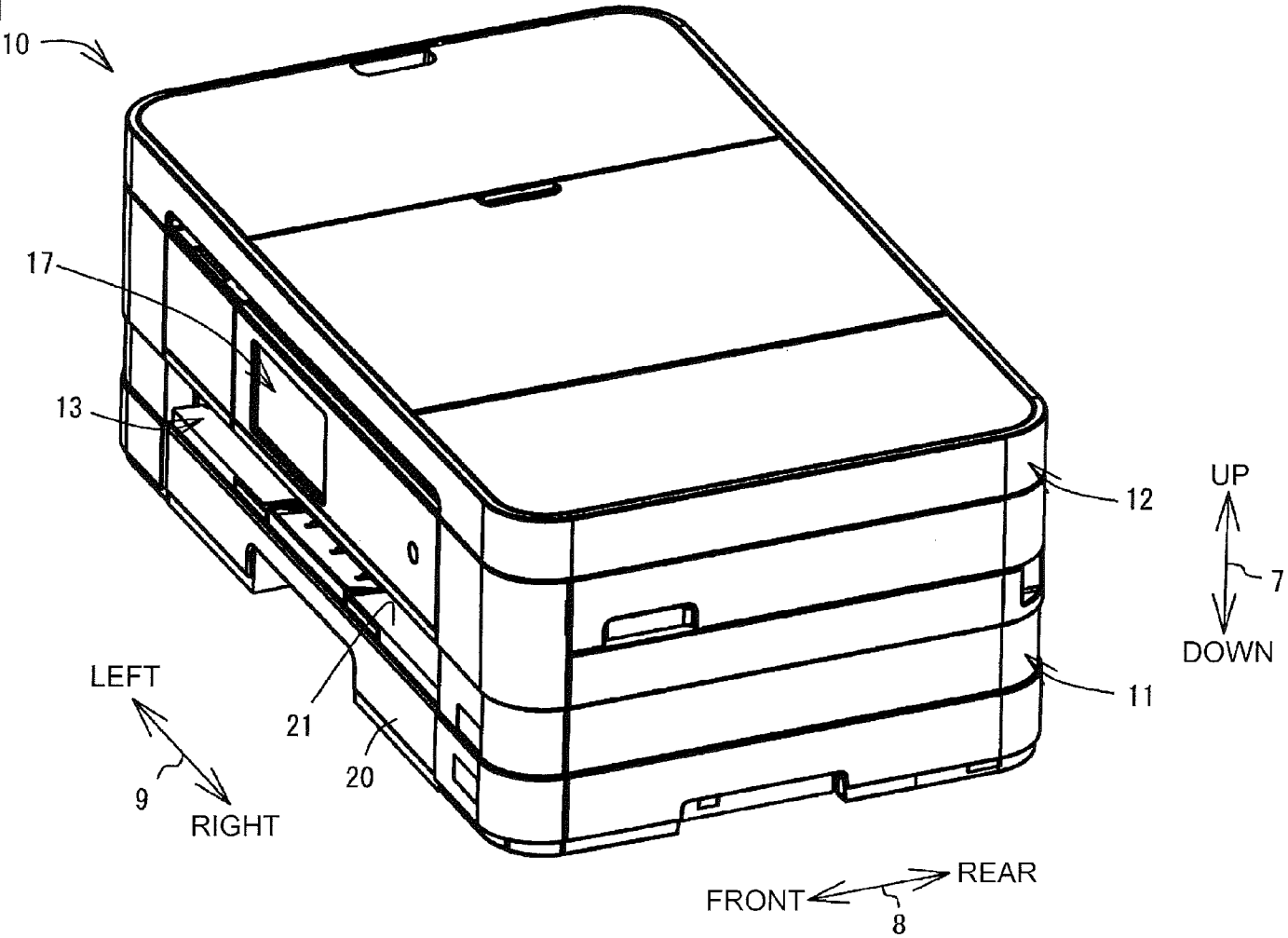
FIG. 1 is a perspective view depicting an inkjet recording apparatus in an illustrative embodiment according to one or more aspects of the disclosure.

Illustrative embodiments according to one or more aspects are described below with reference to the accompanying drawings. The illustrative embodiments described below are only examples. Various changes, arrangements and modifications may be applied therein without departing from the spirit and scope of the disclosure. As depicted in FIG. 1, an up-down direction 7 may be defined with reference to an orientation of a multifunction peripheral 10 that may be disposed in which it may be intended to be used. A side of the multifunction peripheral 10, in which an opening 13 may be defined, may be defined as the front of the multifunction peripheral 10. A front-rear direction 8 may be defined with reference to the front of the multifunction peripheral 10. A right-left direction 9 may be defined with respect to the multifunction peripheral 10 as viewed from its front.

As depicted in FIG. 1, the multifunction peripheral 10 may have a substantially rectangular parallelepiped shape and a relatively lower height. The multifunction peripheral 10 may comprise a scanner portion 12 in an upper part thereof. The scanner portion 12 may be configured to read an image from a document, such as a recording sheet, by an image sensor, to obtain print data. The multifunction peripheral 10 may further comprise a printer portion 11 (an example of an inkjet recording apparatus) in a lower part thereof. The printer portion 11 may be configured to record an image onto a recording sheet 19 (an example of a sheet) (see FIG. 2) based on print data obtained by the scanner portion 12 or print data transmitted from an external device, e.g., a personal computer, connected with the multifunction peripheral 10 via a local-area network ("LAN").

A sheet feed tray 20 (see FIG. 2) may be disposed in the opening 13 defined in the front of the printer portion 11. The sheet feed tray 20 may be configured such that one or more recording sheets 19 are to be placed thereon. The sheet feed tray 20 may be configured to be inserted into or removed from the printer portion 11 by which the sheet feed tray 20 may be slid along the front-rear direction 8. An upper front part of the sheet feed tray 20 may be covered by a sheet discharge tray 21. The sheet discharge tray 21 may be configured to be slidable integrally with the sheet feed tray 20.

Figure 2:
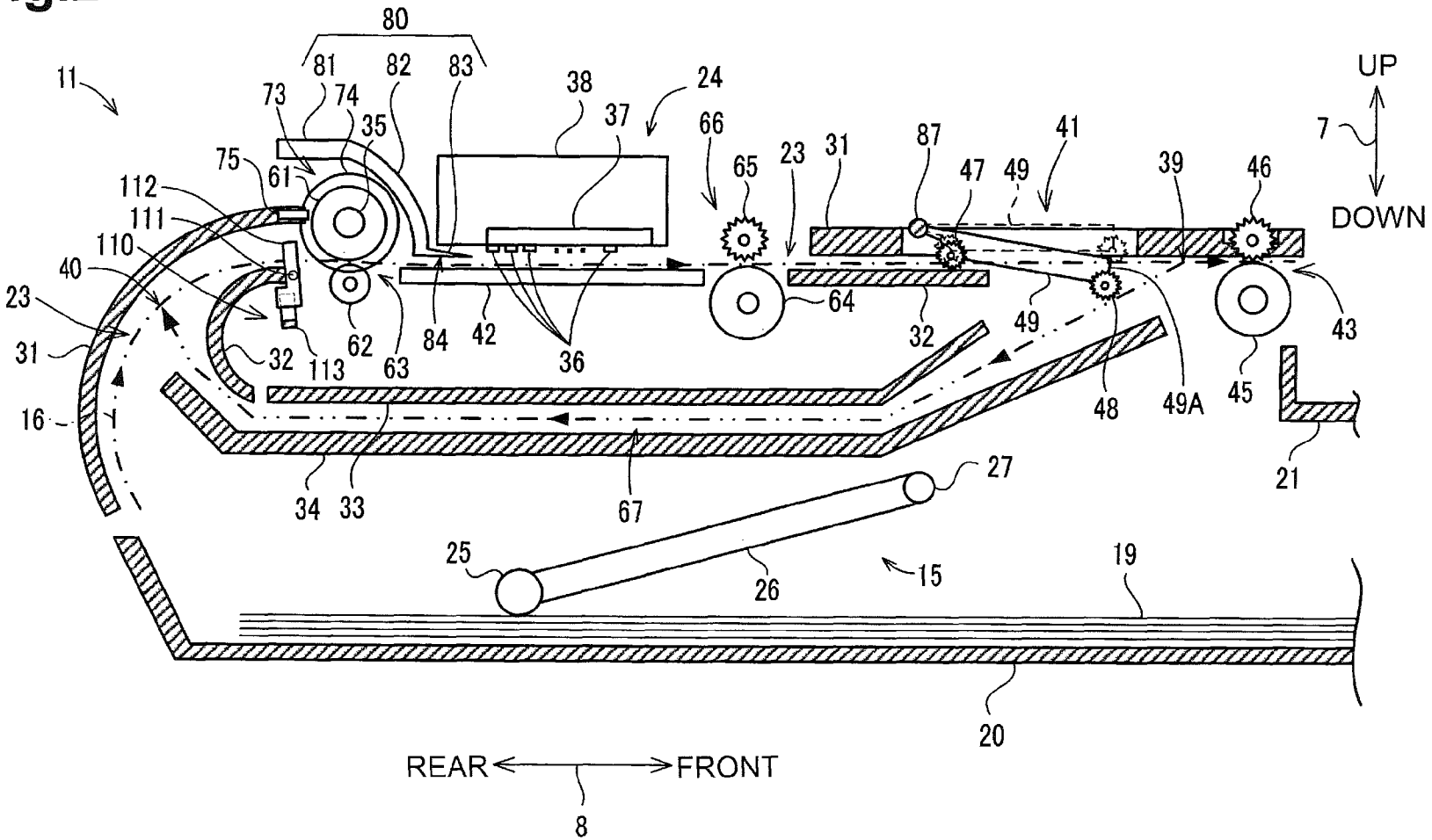
FIG. 2 is a schematic longitudinal sectional view depicting an internal configuration of a printer portion in the illustrative embodiment according to one or more aspects of the disclosure.

As depicted in FIG. 2, the printer portion 11 may comprise a main conveyance path 23, a reverse conveyance path 67, a sheet feed portion 15, a conveyor roller pair 63 (an example of a first conveyor), a discharge roller pair 66, a reverse roller pair 43 (an example of a second conveyor), an inkjet-type recording portion 24, and a path switching member 41. The main conveyance path 23 and the reverse conveyance path 67 may be configured to guide a recording sheet 19 therein. The sheet feed portion 15 may be configured to feed one or more recording sheets 19 placed on the sheet feed tray 20 to the main conveyance path 23. The conveyor roller pair 63 may be disposed in the main conveyance path 23 and configured to convey the recording sheet 19 fed into the main conveyance path 23 by the sheet feed portion 15. The recording portion 24 may be configured to record an image onto the recording sheet 19 based on print data.

As depicted in FIG. 2, the sheet feed portion 15 may be disposed above the sheet feed tray 20 attached in the opening 13 (see FIG. 1) of the printer portion 11. The sheet feed portion 15 may comprise a feed roller 25, a feed arm 26, and a shaft 27.

The feed roller 25 may be rotatably disposed on one end of the feed arm 26. The feed roller 25 may be configured to be rotated by a drive force applied by a sheet feed motor 102 (see FIG. 5). Nevertheless, in other embodiments, the feed roller 25 may be configured to be rotated by a drive force applied by a conveyor motor 101.

The feed arm 26 may be pivotably disposed on the shaft 27 supported by a frame of the printer portion 11. The feed arm 26 may be pivotably urged toward the sheet feed tray 20 by its own weight or an elastic force of a spring. The feed roller 25 may be configured to pick up a recording sheet 19 from the stack of recording sheets 19 placed on the sheet feed tray 20 to feed the recording sheet 19 into the main conveyance path 23 by its rotation.

As depicted in FIG. 2, the main conveyance path 23 may extend upward from a rear end of the sheet feed tray 20 and be curved toward the front. The main conveyance path 23 may pass under the recording portion 24 and further extend to the sheet discharge tray 21. The main conveyance path 23 may be a space defined by a first guide member 31 and a second guide member 32. The first guide member 31 and the second guide member 32 may be spaced apart from each other at a predetermined interval. The first guide member 31 may define an outer side of the main conveyance path 23, while the second guide member 32 may define an inner side of the main conveyance path 23. The first guide member 31 and the second guide member 32 may be, separately or collectively. The recording sheet 19 may be conveyed through the main conveyance path 23 in a direction of an arrow indicated by a dotted and dashed line in FIG. 2. For example, a conveyance direction 16 may correspond to a direction that the main conveyance path 23 extends.

As depicted in FIG. 2, the conveyor roller pair 63 comprising a conveyor roller 61 and a pinch roller 62 may be disposed upstream of the recording portion 24 in the main conveyance path 23 with respect to the conveyance direction 16. The pinch roller 62 may be in pressure contact with a roller surface of the conveyor roller 61 by an elastic member (not depicted), e.g., a spring. A discharge roller pair 66 comprising a discharge roller 64 and a spur 65 may be disposed downstream of the recording portion 24 in the main conveyance path 23 with respect to the conveyance direction 16. The spur 65 may be in pressure contact with a roller surface of the discharge roller 64 by an elastic member (not depicted), e.g., a spring. A reverse roller pair 43 comprising a reverse roller 45 and a spur 46 may be disposed downstream of the discharge roller pair 66 in the main conveyance path 23 with respect to the conveyance direction 16. The spur 46 may be in pressure contact with a roller surface of the reverse roller 45 by an elastic member (not depicted), e.g., a spring.

Figure 5:
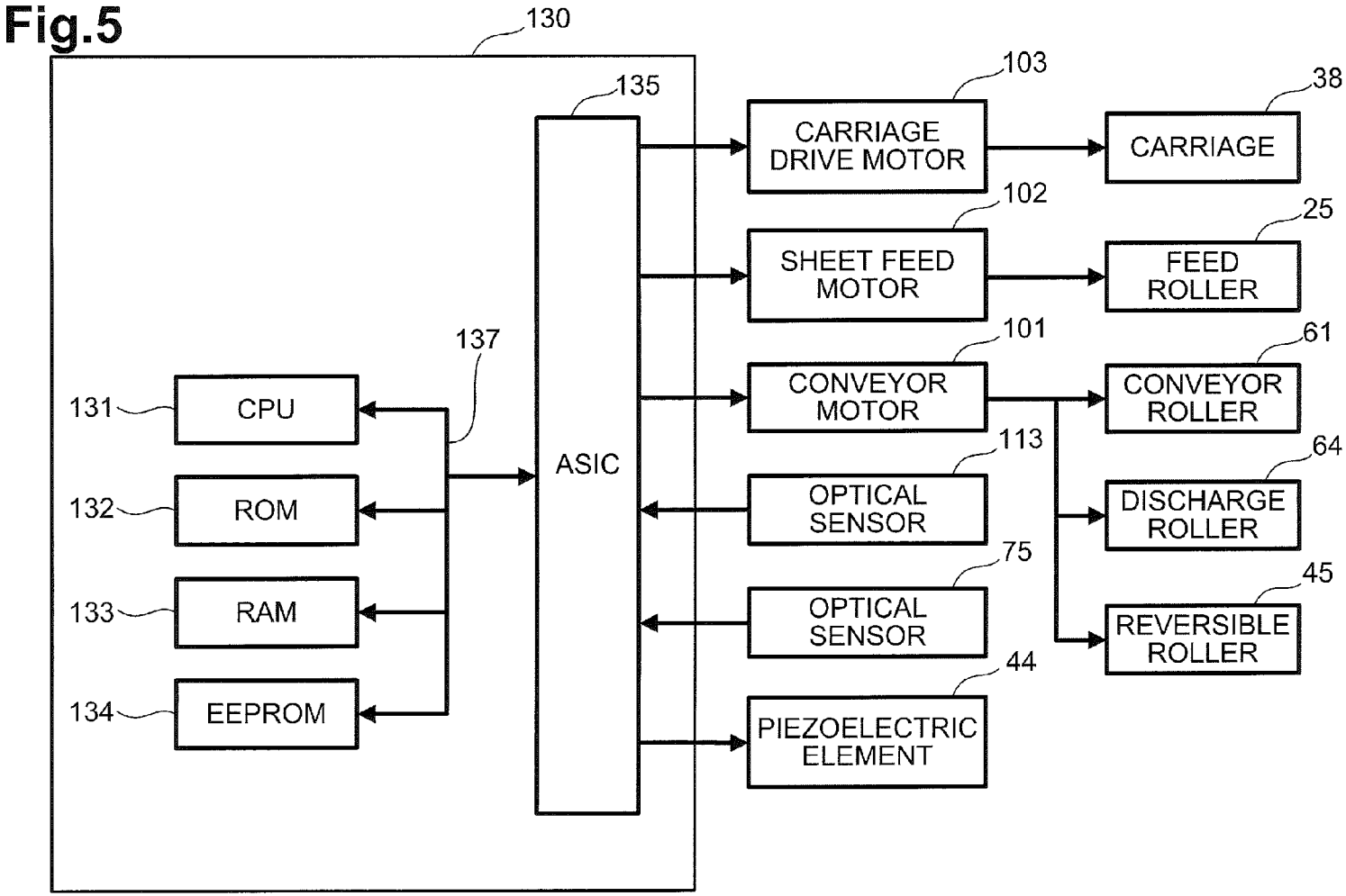
FIG. 5 is a block diagram depicting a configuration of a control device in the illustrative embodiment according to one or more aspects of the disclosure.

The conveyor roller 61, the discharge roller 64, and the reverse roller 45 may be configured to be rotated in either one of a normal direction and a reverse direction by transmission of a drive force from the conveyor motor 101 (see FIG. 5). When each roller pair rotates in the normal direction while pinching a recording sheet 19 therebetween, each roller pair may be configured to convey the recording sheet 19 in the conveyance direction 16. When each roller pair rotates in the reverse direction while pinching the recording sheet 19 therebetween, each roller pair may be configured to convey the recording sheet 19 in a direction opposite to the conveyance direction 16. For a double-sided image recording, a direction that the recording sheet 19 is being conveyed between the discharge roller 64 and the reverse roller 45 in the main conveyance path 23 may be switched to the opposite direction. Then, the recording sheet 19 may be conveyed toward the reverse conveyance path 67.

As depicted in FIG. 2, a platen 42 (an example of a support portion) may be disposed between the conveyor roller pair 63 and the discharge roller pair 66 to define a part of a lower part of the main conveyance path 23. The platen 42 may be configured to support the recording sheet 19 being conveyed in the main conveyance path 23 from below.

Figure 3:
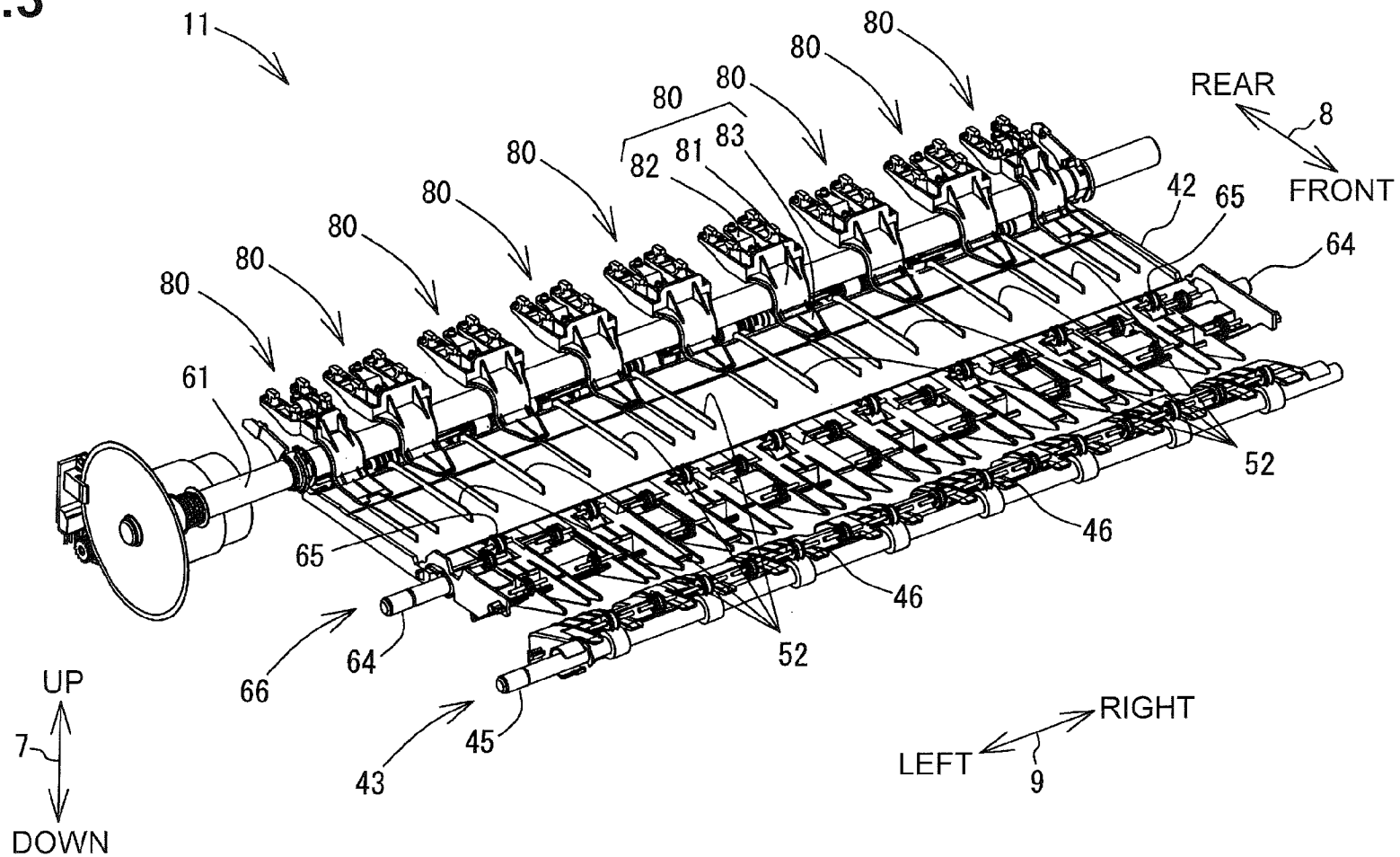
FIG. 3 is a perspective view depicting contact members, a conveyor roller, a discharge roller pair, a reverse roller pair, and a platen in the illustrative embodiment according to one or more aspects of the disclosure.

As depicted in FIG. 3, the platen 42 may comprise a plurality of support ribs 52 (an example of a protrusion) on an upper surface thereof. The support ribs 52 may protrude upward from the upper surface of the platen 42. The support ribs 52 may extend along the front-rear direction 8 and may be spaced apart from each other with respect to the right-left direction 9 (an example of a width direction) at a predetermined interval. The recording sheet 19 being conveyed in the main conveyance path 23 may be supported by the platen 42, and more specifically, by the support ribs 52 provided on the upper surface of the platen 42.

As depicted in FIG. 2, the recording portion 24 may be disposed opposingly above the platen 42. The recording portion 24 may comprise a carriage 38 and a recording head 37. The carriage 38 may be supported by the frame of the printer portion 11. The carriage 38 may be connected with a carriage drive motor 103 (see FIG. 5) via a known belt mechanism (not depicted) and configured to reciprocate along the right-left direction 9 by transmission of a drive force from the carriage drive motor 103.

The recording head 37 may comprise a plurality of nozzles 36 defined in its lower surface, ink channels (not depicted), and a piezoelectric element 44 (see FIG. 5). The ink channels may connect sub-tanks (not depicted) with the nozzles 36. The piezoelectric element 44 may be configured to deform the ink channels partially to allow the nozzles 36 to eject ink droplets therefrom. The nozzles 36 may be configured to eject ink droplets toward the platen 42. The piezoelectric element 44 may be configured to be activated by power supplied by a control device 130 (see FIG. 5).

Each sub-tank may be configured to store ink of one of colors of cyan, magenta, yellow, and black. In the illustrative embodiment, a first nozzle row (not depicted) comprising a plurality of the nozzles 36 may be provided for the sub-tank for cyan ink. The first nozzle row may extend along the front-rear direction 8. Similar to the first nozzle row, a second nozzle row, a third nozzle row, and a fourth nozzle row may be provided for the sub-tank for magenta ink, the sub-tank for yellow ink, and the sub-tank for black ink, respectively. Thus, the nozzles 36 may be arranged in a plurality of rows extending along the conveyance direction 16 (i.e., the front-rear direction 8). The nozzle rows may be arranged side by side in the right-left direction 9.

The recording portion 24 may be configured to be controlled by the control device 130 (see FIG. 5). With this control, in the recording portion 24, ink droplets may be ejected toward the platen 42 from the nozzles 36 defined in the recording head 37 while the carriage 38 reciprocates along the right-left direction 9. Thus, an image may be recorded on a recording sheet 19 held by the the platen 42. When the recording head 37 has the nozzles 36 defined across an area that corresponds to an entire recording area of the recording sheet 19 in the right-left direction 9, the recording portion 24 might not necessarily comprise the carriage 38.

Figure 4:
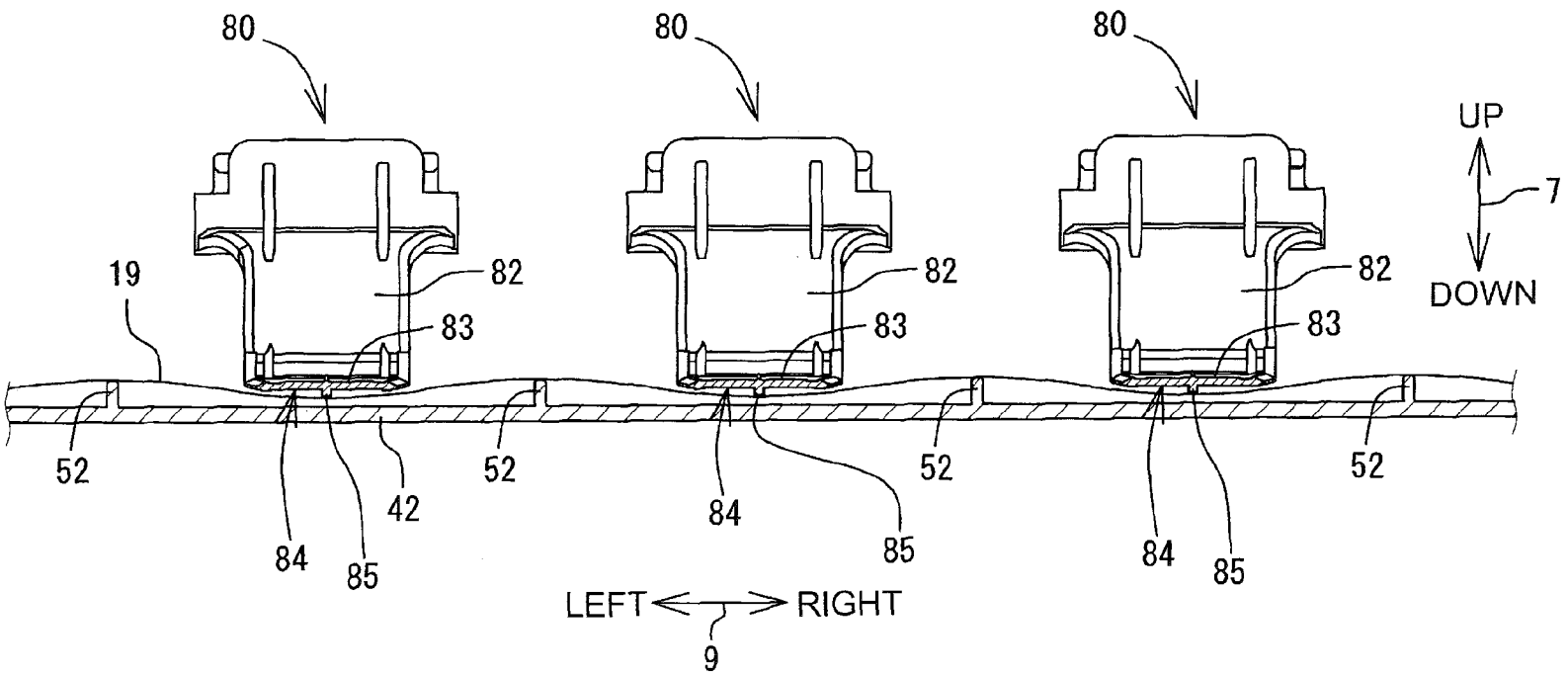
FIG. 4 is a front view depicting the platen, the contact members, and a recording sheet in the illustrative embodiment according to one or more aspects of the disclosure.

As depicted in FIGS. 2-4, a plurality of contact members 80 may be disposed upstream of the nozzles 36 in the main conveyance path 23 with respect to the conveyance direction 16. The contact members 80 may be spaced apart from each other with respect to the right-left direction 9. In the illustrative embodiment, as depicted in FIG. 3, for example, nine contact members 80 may be disposed. As depicted in FIGS. 2 and 3, each contact member 80 may comprise a fixing portion 81, a curved portion 82, and a contact portion 83.

The fixing portion 81 may be configured to be fixed to the frame of the printer portion 11. The curved portion 82 may curvedly extend forward and downward from the fixing portion 81. The contact portion 83 may have a plate-like shape. The contact portion 83 may be located upstream of the nozzles 36 of the recording head 37 (e.g., the rearmost nozzles of nozzles 36 in the respective rows) with respect to the conveyance direction 16 and opposite to the platen 42 when the fixing portion 81 is fixed to the frame of the printer portion 11.

As depicted in FIG. 4, the contact portion 83 may comprise a contact rib 85 on a lower surface 84 thereof. The contact rib 85 may protrude downward from the lower surface 84 of the contact portion 83. A lower end of the contact rib 85 may be located lower than the lower surface of the recording head 37, and may be configured to come into contact with an image recording surface, e.g., an upper surface, of the recording sheet 19 held on the platen 42. With this configuration, the recording sheet 19 may be pressed downward, e.g., toward the platen 42, by the contact portion 83.

Each of the contact portions 83 may be disposed between respective pairs of the support ribs 52 disposed on the platen 42 in the right-left direction 9. For example, the contact portions 83 might not face the support ribs 52. As depicted in FIG. 4, the support ribs 52 may protrude such that their upper ends may be located higher than the lower ends of the contact ribs 85 of the contact portions 83. In some arrangements, an upper end of the platen 42 may be located lower than the lower ends of the contact portions 83. With this configuration, the recording sheet 19 being conveyed in the main conveyance path 23 may be maintained in a corrugated shape between the platen 42 and the contact portions 83 when viewed from the front or the rear of the multifunction peripheral 10.

As depicted in FIG. 2, a detector 110 may be disposed upstream of the conveyor roller pair 63 in the main conveyance path 23 with respect to the conveyance direction 16. The detector 110 may comprise a shaft 111, a detector element 112, and an optical sensor 113. The detector element 112 may be configured to be pivotable about the shaft 111. The optical sensor 113 may comprise a light-emitting device and a light-receiving device that may be configured to receive light emitted from the light-emitting device.

One end of the detector element 112 may protrude into the main conveyance path 23. When an external force is not applied to the one end of the detector element 112, the other end of the detector element 112 may be present in an optical path of light emitted from the light-emitting device to the light-receiving device in the optical sensor 113 to interrupt travel of light traveling the optical path. In this situation, the optical sensor 113 may be configured to output a low level signal to the control device 130 (see FIG. 5). When the one end of the detector element 112 is pivoted toward the downstream of the conveyance direction 16 by a downstream edge of the recording sheet 19 being conveyed, the other end of the detector element 112 may be moved to out of the optical path. Thus, light may travel along the optical path. In this situation, the optical sensor 113 may be configured to output a high level signal to the control device 130. The control device 130 may be configured to detect a downstream edge and an upstream edge of the recording sheet 19 with respect to the conveyance direction 16 in accordance with a signal outputted from the optical sensor 113.

As depicted in FIG. 2, a rotary encoder 73 may be disposed on the conveyor roller 61 to detect a rotation amount of the conveyor roller 61. The rotary encoder 73 may comprise an encoder disk 74 and an optical sensor 75. The encoder disk 74 may be disposed on a shaft 35 of the conveyor roller 61 and configured to rotate integrally with the conveyor roller 61. The encoder disk 74 may have a pattern in which a transmitting portion and a non-transmitting portion may be alternately arranged in a circumference direction at regular intervals. The transmitting portion may allow light to pass therethrough and the non-transmitting portion may not allow light to pass therethrough. As the encoder disk 74 rotates, a pulse signal may be generated every time the optical sensor 75 detects the transmitting portion and the non-transmitting portion alternately. The generated pulse signal may be outputted to the control device 130 (see FIG. 5). The control device 130 may be configured to calculate the rotation amount of the conveyor roller 61 based on the received pulse signals.

As depicted in FIG. 2, the path switching member 41 may be disposed between the discharge roller 64 and the reverse roller 45. The path switching member 41 may comprise auxiliary rollers 47, 48, a flap 49, and a shaft 87. The flap 49 may extend from the shaft 87 in substantially the conveyance direction 16 and may be rotatably supported by the shaft 87. The spur-like auxiliary rollers 47, 48 may be supported by the flap 49 via respective shafts.

The flap 49 may be configured to be pivotable between a sheet-discharge position (e.g., indicated by a dashed line in FIG. 2) and a sheet-reverse position (e.g., indicated by a solid line in FIG. 2). When the flap 49 is located in the sheet-discharge position, the flap 49 may allow the recording sheet 19 to be discharged onto the discharge tray 21. When the flap 49 is located in the sheet-reverse position, an extended end portion 49A of the flap 49 may be located lower than the extended end portion 49A of the flap 49 located in the sheet-discharge position.

The flap 49 may be configured to stay in the sheet-reverse position under its own weight when the flap 49 is in a standby state. The flap 49 may be configured to be pivoted (e.g., raised) to the sheet-discharge position by the recording sheet 19 being conveyed in the main conveyance path 23. Thereafter, the flap 49 (e.g., the auxiliary rollers 47, 48) may guide the recording sheet 19 while being in contact with the recording sheet 19. When the upstream edge of the recording sheet 19 with respect to the conveyance direction 16 passes the auxiliary roller 47, the flap 49 may be configured to pivot to the sheet-reverse position from the sheet-discharge position under its own weight. Therefore, the upstream edge of the recording sheet 19 with respect to the conveyance direction 16 may move downward. Thus, the direction in which the upstream edge of the recording sheet 19, with respect to the conveyance direction 16, points may be changed toward the reverse conveyance path 67. When the reverse roller 45 rotates in the normal direction under this condition, the recording sheet 19 may be further conveyed in the conveyance direction 16 and thus discharged onto the discharge tray 21. When the reverse roller 45 rotates in the reverse direction under this condition, the recording sheet 19 may be conveyed in a direction opposite to the conveyance direction 16 and thus may be led into the reverse conveyance path 67.

The reverse conveyance path 67 may be branched off from the main conveyance path 23 at a first position 39 located between the discharge roller 64 and the reverse roller 45. The reverse conveyance path 67 may join the main conveyance path 23 at a second position 40 located upstream of the conveyor roller 61 with respect to the conveyance direction 16. The reverse conveyance path 67 may be a space defined by a third guide member 33 and a fourth guide member 34 that may face each other while being spaced apart from each other at a predetermined interval. The third guide member 33 may define an upper part of the reverse conveyance path 67. The fourth guide member 34 may define a lower part of the reverse conveyance path 67. The third guide member 33 and the fourth guide member 34 may be an example of a reverse guide portion. The recording sheet 19 may be conveyed in the reverse conveyance path 67 from the first position 39 to the second position 40 (e.g., a direction indicated by a double dotted and dashed line in FIG. 2).

Hereinafter, referring to FIG. 5, a schematic configuration of the control device 130 is described. Aspects of the disclosure may be implemented such that the control device 130 may perform a recording control in accordance with flowcharts in FIGS. 9 and 10. The control device 130 may be configured to control operation of the multifunction peripheral 10. The control device 130 may comprise a central processing unit ("CPU") 131, a read-only memory ("ROM") 132, a random-access memory ("RAM") 133, an electrically erasable programmable read-only memory ("EEPROM") 134, an application-specific integrated circuit ("ASIC") 135, and an internal bus 137 that may connect them each other.

The ROM 132 may store programs (e.g., machine readable instructions) for controlling various operations including the recording control to be performed by the CPU 131. The RAM 133 may be configured to be used as a storage area for temporary storing data and signals to be used when the CPU 131 carries out the program. The RAM 133 may be configured to accumulate ink amount data as database. The EEPROM 134 may be configured to store settings and flags that may need to be maintained after power of the multifunction peripheral 10 is turned off.

The conveyor motor 101, the sheet feed motor 102, and the carriage drive motor 103 may be connected to the ASIC 135. The ASIC 135 may be equipped with a drive circuit for controlling each motor. As a drive signal for rotating a predetermined motor is inputted from the CPU 131 to the drive circuit corresponding to the predetermined motor, a drive current corresponding to the drive signal may be outputted to the motor corresponding to the drive circuit. Thus, the corresponding motor may be rotated. That is, the control device 130 may be configured to control each motor 101, 102, 103.

A pulse signal outputted from the optical sensor 75 may be inputted to the ASIC 135. The control device 130 may be configured to calculate the rotation amount of the conveyor roller 61 based on the pulse signal received from the optical sensor 75. Then, the control device 130 may be configured to calculate a conveyed amount of a recording sheet 19 based on the rotation amount of the conveyor roller 61. The optical sensor 113 may be connected with the ASIC 135. The control device 130 may be configured to detect a downstream edge and an upstream edge of a recording sheet 19 with respect to the conveyance direction 16 at the disposed position of the detector 110, based on a signal from the optical sensor 113.

The piezoelectric element 44 may be connected to the ASIC 135. The piezoelectric element 44 may be configured to be activated by power supplied from the control device 130 via a drive circuit (not depicted). The control device 130 may be configured to control the power supply to the piezoelectric element 44 in accordance with print data to allow the nozzles 36 arranged in each nozzle row to eject ink droplets selectively therefrom. In one example, the control device 130 may allow a part or all of the plurality of nozzles 36 to eject ink droplets therefrom. The control device 130 may be further configured to control a size of each ink droplet to be ejected from the nozzles 36 by controlling the power supply to the piezoelectric element 44 in accordance with the print data. For example, an amount of ink to be ejected from each nozzle 36 may be determined based on the print data and the control device 130 may allow the recording portion 24 to record an image onto a recording sheet 19 based on the print data.

The control device 130 may be configured to calculate an amount of ink ejected onto a sheet based on print data in a print process (e.g., steps S40 and S120 in FIGS. 9, and S250 and S330 in FIG. 10) of the recording control. The control device 130 may be configured to store the calculated ink amount in the RAM 133.

The calculation of the ink amount may be performed, for example, as described below. The control device 130 may determine how many colors of ink of ink droplets have been ejected onto the recording sheet 19 (e.g., one color such as black, when monochrome printing is performed, or at least one color of four colors of cyan, magenta, yellow, and black, i.e., one to four colors, when color printing is performed) and a number of times ink droplets of each color has been ejected (e.g., the number of times ink droplets ejected may become greater as a print density becomes higher), with reference to print data, when an image was recorded on the recording sheet 19. For each color, the control device 130 may calculate an amount of ejected ink by multiplying an amount of ink in one ink droplet by the number of ejections. Then, the control device 130 may add up the ejected ink amounts of ink of four colors. Thus, the total amount of ink ejected onto the recording sheet 19 may be calculated.

Figure 6:
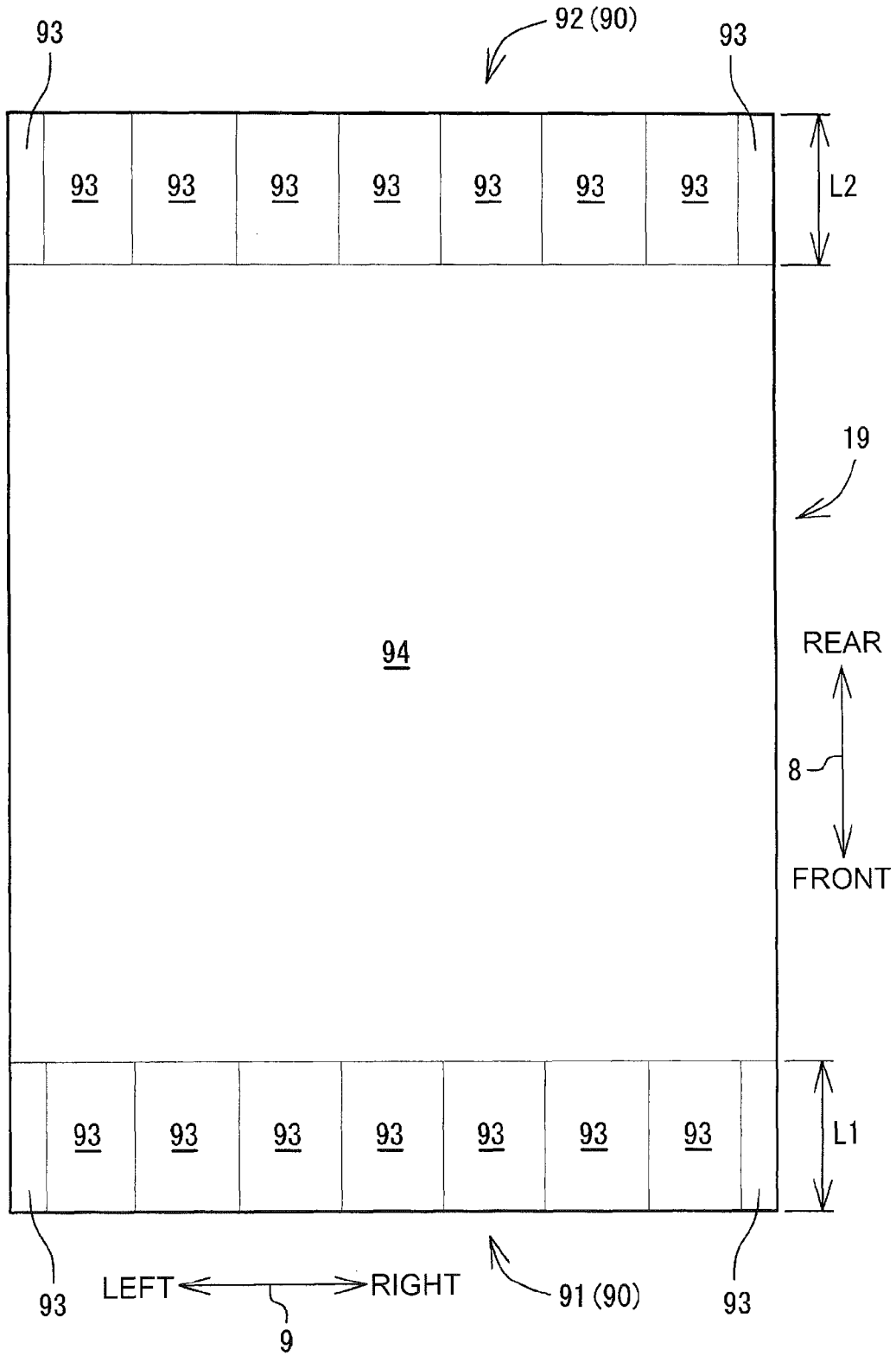
FIG. 6 is a schematic view depicting divided areas simulatively defined on a recording surface of a recording sheet in the illustrative embodiment according to one or more aspects of the disclosure.

As described below, the control device 130 may be allowed to calculate an amount of ink ejected onto each end area 90 (see FIG. 6) of a recording sheet 19 when an image is recorded. As depicted in FIG. 6, the end areas 90 may refer to a downstream end area 91 and an upstream end area 92, respectively, of a recording sheet 19 with respect to the conveyance direction 16. The downstream end area 91 may refer to an area that may extend between a right edge and a left edge of a recording sheet 19 in the right-left direction 9 and further extend by a predetermined length L1 in the direction opposite to the conveyance direction 16 from a downstream edge of the recording sheet 19 with respect to the front-rear direction 8. The upstream end area 92 may refer to an area that may extend between the right edge and the left edge of the recording sheet 19 in the right-left direction 9 and further extend by a predetermined length L2 in the conveyance direction 16 from an upstream edge of the recording sheet 19 with respect to the front-rear direction 8.

Figure 12A:
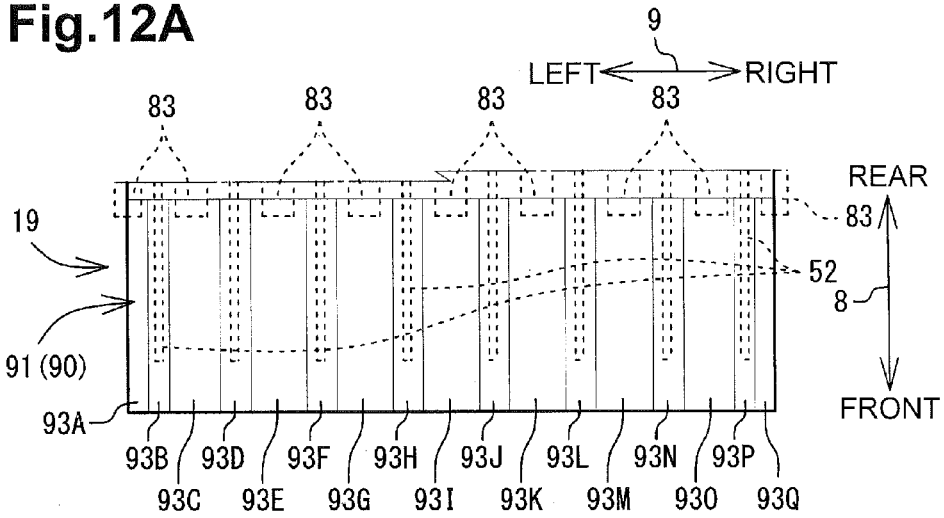
FIGS. 12A-12C are schematic plan views depicting a recording sheet, the contact portions, and support ribs for explaining definitions of the divided areas in the recording sheet in the illustrative embodiment according to one or more aspects of the disclosure.

In the illustrative embodiment, the control device 130 may be configured to calculate an ink amount for each of divided areas 93. Divided areas 93 may correspond to a plurality of areas into which each of the downstream end area 91 and the upstream end area 92 may be divided. For example, the divided areas 93 may refer to a plurality of divided areas of the downstream end area 91 and the upstream end area 92 in the right-left direction 9. In the illustrative embodiment, as depicted in FIG. 12A, each of the downstream end area 91 and the upstream end area 92 may be divided into the plurality of divided areas 93 (e.g., divided areas 93A-93Q) at boundaries defined at respective positions which may face a position between one support rib 52 and one contact portion 83 adjacent to the one support rib 52 with respect to the right-left direction 9. In some examples, all of the divided areas 93 may have the same size. Alternatively, at least some of the divided areas 93 may different respective sizes. In the illustrative embodiment, both endmost ones of the divided areas 93 in the right-left direction 9 may have a size smaller than the other divided areas 93.

In the printer portion 11 configured as described above, a series of recording control from the feeding of a recording sheet 19 to the recording an image onto the fed recording sheet 19 based on print data may be performed by the control device 130. Hereinafter, referring to FIGS. 9 and 10, a recording control process is described.

When the control device 130 detects an instruction to print an image on one or more recording sheets 19 issued via an operation portion 17 (see FIG. 1) of the multifunction peripheral 10 or by an external device connected to the multifunction peripheral 10 (step S10), the control device 130 may allow the feed roller 25 to feed one or more recording sheets 19 from a stack placed on the sheet feed tray 20 into the conveyance path 23 (step S20). Then, the control device 130 may allow the conveyor roller pair 63 to convey the recording sheet 19, one by one, by rotating the conveyor roller 61 in the normal direction until a downstream edge of the recording sheet 19 with respect to the conveyance direction 16 reaches a print start position where the downstream edge of the recording sheet 19 may face the recording portion 24 (step S30). The print start position may refer to a position where a downstream edge of an image recording area of a recording sheet 19 with respect to the conveyance direction 16 may face the nozzles 36 defined in an upstream end of the recording head 37 with respect to the conveyance direction 16. With the performance of step S30, a so-called start finding process, in which a print start position on a first surface to be printed on the recording sheet 19 may be found, may be completed. The control device 130 may be configured to perform the start finding process for the recording sheet 19 whose first surface is to be printed, based on the signals outputted from the optical sensor 113 and the optical sensor 75, e.g., the amount of the recording sheet 19 conveyed since a leading edge of the recording sheet 19 is detected by the detector 110.

Next, the control device 130 may perform operations for recording an image onto the first surface of the recording sheet 19 (steps S40-S160). The operations may be repeatedly performed until all images based on the print data are recorded onto the recording sheet 19 (NO in step S160).

In the illustrative embodiment, the operation may be divided to three parts in which one part may comprise a recording of an image onto a downstream part of the recording sheet 19 with respect to the conveyance direction 16 (steps S40-S80) and another part may comprise a recording of an image onto an intermediate part of the recording sheet 19 with respect to the conveyance direction 16 (steps S90-S110), and a further part may comprise a recording of an image onto an upstream part of the recording sheet 19 with respect to the conveyance direction 16 (steps S120-S160). The downstream part of the recording sheet 19 with respect to the conveyance direction 16 may refer to the downstream end area 91 (see FIG. 6) of the recording sheet 19. The upstream part of the recording sheet 19 with respect to the conveyance direction 16 may refer to the upstream end area 92 (see FIG. 6) of the recording sheet 19. The intermediate part of the recording sheet 19 with respect to the conveyance direction 16 may refer to an intermediate area 94 (see FIG. 6) of the recording sheet 19 other than the downstream end area 91 and the upstream end area 92.

The control device 130 may perform intermittent conveyance (step S70) when an image is recorded on the downstream part of the recording sheet 19 with respect to the conveyance direction 16. The control device 130 may perform the intermittent conveyance by controlling the conveyor motor 101 to allow the conveyor roller pair 63 and the discharge roller pair 66 to repeatedly and alternately convey the recording sheet 19 by a predetermined line feed and stop the conveyance of the recording sheet 19. During stoppage of the conveyance of the recording sheet 19 in the intermittent conveyance, the control device 130 may allow the nozzles 36 to eject ink droplets therefrom by controlling the power supply to the piezoelectric element 44 while moving the carriage 38 in a main scanning direction (e.g., the right-left direction 9) (step S40). More specifically, the control device 130 may allow the nozzles 36 to eject ink droplets therefrom in one pass in which the carriage 38 may move across a print area in the main scanning direction (e.g., the right-left direction 9). The control device 130 may perform the printing onto the recording sheet 19 (step S40) until there is no more print data for an image to be recorded onto the downstream end area 91 (NO in step S80) while stopping the conveyance of the recording sheet 19 in the intermittent conveyance (step S70). The control device 130 may perform a first stop-control determination (step S50) and a first stop-control (step S60) between the printing onto the recording sheet 19 (step S40) and the conveyance of the recording sheet 19 (step S70).

According to some arrangements, when an image is recorded onto the intermediate part of the recording sheet 19 with respect to the conveyance direction 16, the control device 130 may perform the printing onto the recording sheet 19 (step S90) until there is no more print data for recording the image onto the intermediate part (NO in step S110) while stopping the conveyance of the recording sheet 19 in the intermittent conveyance (step S100), similar to the case where an image is recorded onto the downstream part of the recording sheet 19 with respect to the conveyance direction 16. However, when an image is recorded onto the intermediate part of the recording sheet 19 with respect to the conveyance direction 16, the control device 130 might not perform the first stop-control determination and the first stop-control, as distinct from the case where an image is recorded onto the downstream part of the recording sheet 19 with respect to the conveyance direction 16.

Also, when an image is recorded onto the upstream part of the recording sheet 19 with respect to the conveyance direction 16, the control device 130 may perform the printing onto the recording sheet 19 (step S120) until there becomes no more print data for recording an image onto the upstream part (NO in step S160) while stopping the conveyance of the recording sheet 19 in the intermittent conveyance (step S150), similar to the case where an image is recorded onto the downstream part of the recording sheet 19 with respect to the conveyance direction 16. When an image is recorded onto the upstream part of the recording sheet 19 with respect to the conveyance direction 16, the control device 130 may perform the first stop-control determination (step S130) and the first stop-control (step S140), similar to the case where an image is recorded onto the downstream part of the recording sheet 19 with respect to the conveyance direction 16.

When no more print data exists for recording an image onto the upstream end area 92 of the recording sheet 19, e.g., when a recording of an image onto the first surface of the recording sheet 19 is completed (NO in step S160), the control device 130 may allow the discharge roller pair 66 and the reverse roller pair 43 to convey the recording sheet 19 by rotating the discharge roller 64 and the reverse roller 45 in the normal direction until the upstream edge of the recording sheet 19 reaches a turn-back position (step S170). The turn-back position may be defined between the auxiliary roller 47 and the auxiliary roller 48.

When the upstream edge of the recording sheet 19 reaches the turn-back position, the control device 130 may change the rotational direction of the reverse roller 45 from the normal direction to the reverse direction. Thus, the recording sheet 19 may be conveyed in the opposite direction to the conveyance direction 16 and thus may be led into the reverse conveyance path 67. In one example, the control device 130 may turn back the recording sheet 19 in the opposite direction (step S180). After that, the recording sheet 19 may be conveyed in the reverse conveyance path 67 by a roller pair (not depicted) disposed in the reverse conveyance path 67 and further conveyed in the main conveyance path 23 again via the second position 40. Then, the control device 130 may detect the recording sheet 19 by the detector 110 (step S190).

The control device 130 may perform a second stop-control determination (step S200) to determine whether a second stop-control (step S220) needs to be performed. When the control device 130 determines that a second stop-control needs to be performed (YES in step S200), the control device 130 may convey the recording sheet 19 in the conveyance direction 16 until a downstream edge of the recording sheet 19 with respect to the conveyance direction 16 reaches a second stop-control position (step S210). The second stop-control position may refer to a position where the downstream edge of the recording sheet 19 with respect to the conveyance direction 16 may face the contact portions 83, e.g., the downstream edge of the recording sheet 19 may come into contact with the contact portions 83. In the illustrative embodiment, the second stop-control position may refer to a position depicted in FIG. 7E, e.g., the downstream edge of the recording sheet 19 with respect to the conveyance direction 16 may come into contact with protruding ends of the contact portions 83. The control device 130 may perform the conveyance of the recording sheet 19 whose second surface is to be printed to the second stop-control position (step S210) and the conveyance of the recording sheet 19 to the print start position (steps S230 and S240) based on the signals outputted from the optical sensor 113 and the optical sensor 75, e.g., the amount of recording sheet 19 conveyed since the leading edge of the recording sheet 19 is detected by the detector 110.

When the control device 130 determines that the second stop-control need not to be performed (NO in step S200), the control device 10 may convey the recording sheet 19 in the conveyance direction 16 until the downstream edge of the recording sheet 19 with respect to the conveyance direction 16 reaches the print start position (step S240). With the performance of step S240, the start finding process in which a print start position on the second surface of the recording sheet 19 may be found may be completed.

Then, the control device 130 may perform operations of recording an image onto the second surface of the recording sheet 19 (steps S250-S370). The operations may be the same as the operation of recording an image onto the first surface of the recording sheet 19. For example, processing of steps S250-S370 may correspond to the processing of steps S40-S160, respectively.

When no more print data exists for recording an image onto the upstream end area 92 of the recording sheet 19, e.g., when the recording of an image onto the second surface of the recording sheet 19 is completed (NO in step S370), the control device 130 may allow the discharge roller pair 66 and the reverse roller pair 43 to convey the recording sheet 19 to the sheet discharge tray 21 by rotating the discharge roller 64 and the reverse roller 45 in the normal direction (step S380). For example, the control device 130 may perform a process for discharging the recording sheet 19.

Referring to FIGS. 7A-7D, 7G, 7H, 9, 10, and 11A, the first stop-control determination and the first stop-control are now described.

Figure 9:
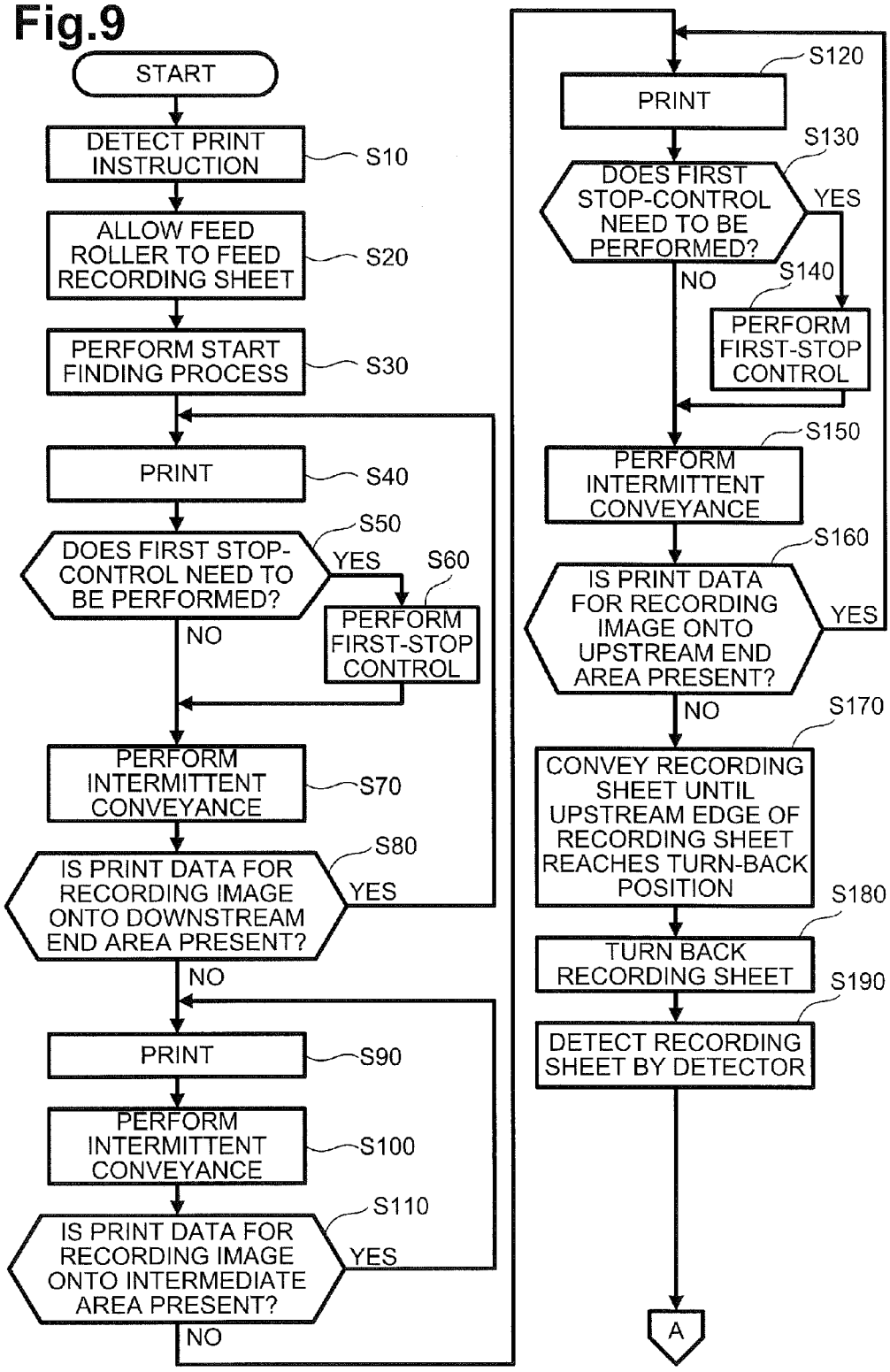
FIG. 9 is a flowchart depicting a recording control process in the illustrative embodiment according to one or more aspects of the disclosure.
Figure 10:
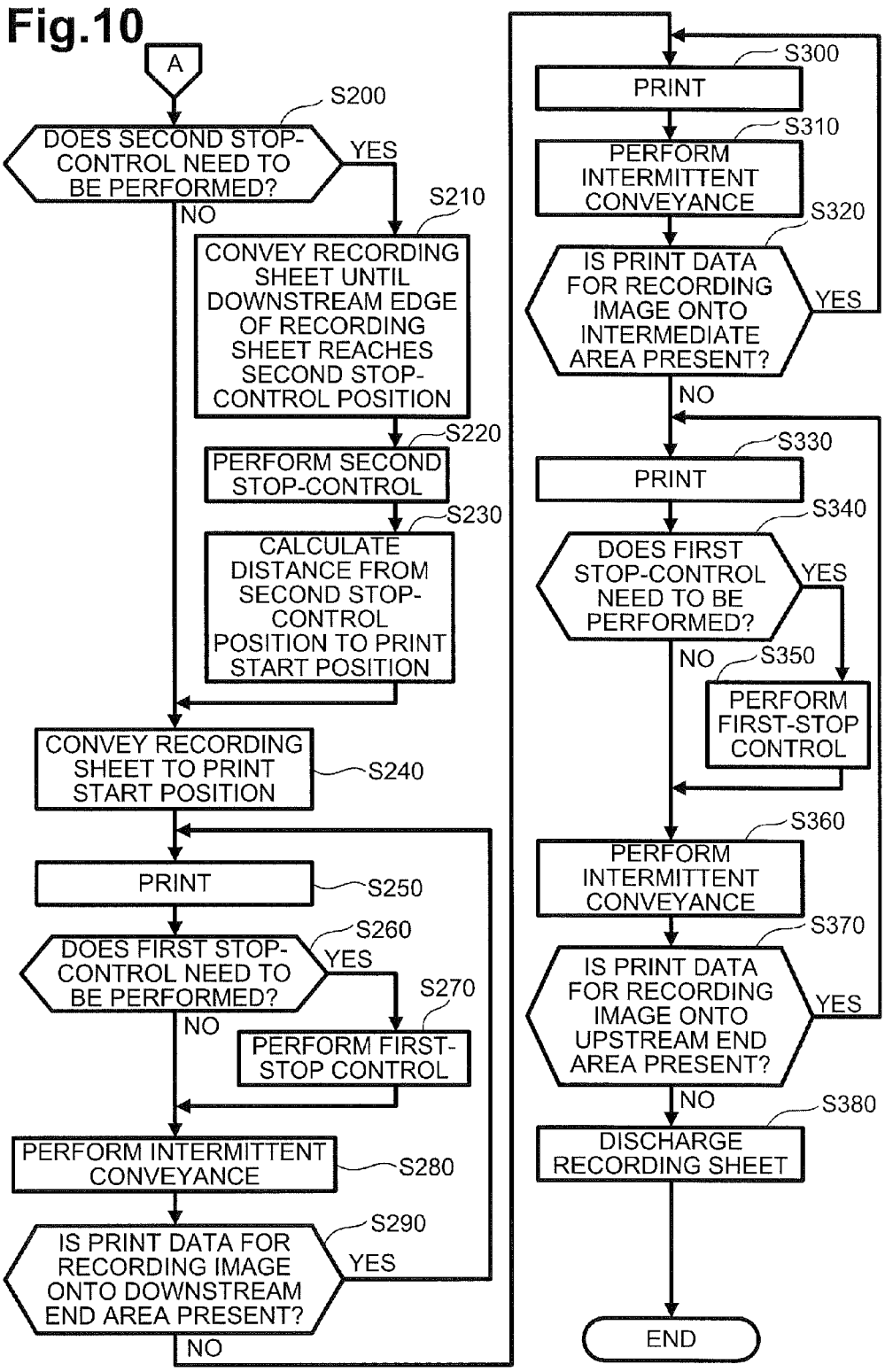
FIG. 10 is a continuation of the flowchart of FIG. 9 in the illustrative embodiment according to one or more aspects of the disclosure.

In the first stop-control determination, processing of steps S600-S630 may be performed in each of steps S50 and S130 of FIG. 9 and steps S260 and S340 of FIG. 10.

First, the first stop-control determination performed in each of steps S50 and S260, e.g., the first stop-control determination for the downstream end areas 91 of the first and second surfaces, respectively, of the recording sheet 19 with respect to the conveyance direction 16, is described. The control device 130 may read the ink amount needed for forming a corresponding portion of the image in each divided area 93 from the RAM 133 (step S600), wherein the ink amount has been calculated for each divided area 93 and stored in the RAM 133 in the previous step (e.g., the print process in which an image is recorded on the downstream end area 91 of the recording sheet 19 in step S40 or S250).

The control device 130 may calculate an average value of the read ink amounts of the respective divided areas 93 constituting the downstream end area 91. Then, the control device 130 may compare the calculated average value with a predetermined average threshold value $\alpha 1$ (step S610). When the calculated average value is greater than the average threshold value $\alpha 1$ (YES in step S610), the control device 130 may perform the first stop-control (step S60 in FIG. 9 and step S270 in FIG. 10).

Figure 7A:
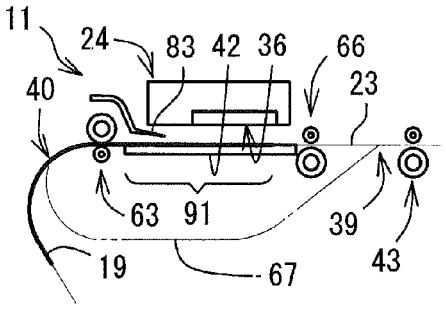
FIGS. 7A, 7C, 7E, and 7G are schematic sectional views depicting the printer portion for explaining a condition of a recording sheet during recording control in the illustrative embodiment according to one or more aspects of the disclosure.
Figure 7B:
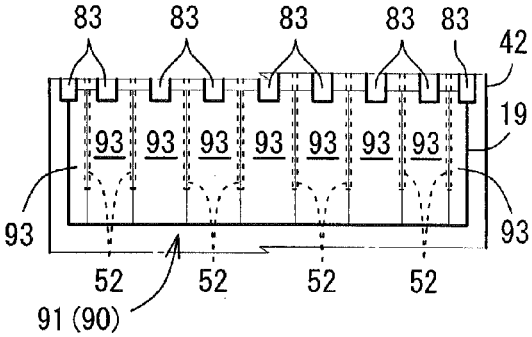
FIGS. 7B, 7D, 7F, and 7H are schematic plan views depicting the recording sheet and the platen during the recording control in FIGS. 7A, 7C, 7E, and 7G, respectively, in the illustrative embodiment according to one or more aspects of the disclosure.

The first stop-control may be performed by the control device 130 to stop the conveyance of the recording sheet 19 for a predetermined time period. In the first stop-control in step S60, as depicted in FIGS. 7A and 7B, the conveyance of the recording sheet 19 may be stopped by the control device 130 in a state where the downstream end area 91 of the recording sheet 19 may face the nozzles 36 and the contact portions 83. In the first stop-control in step S270, as depicted in FIGS. 7G and 7H, the conveyance of the recording sheet 19 may be stopped by the control device 130 in a state where the downstream end area 91 of the recording sheet 19 may face the nozzles 36 and the contact portions 83. For example, an area including the downstream edge of the recording sheet 19 in the downstream end area 91 may face the nozzles 36 and an area not including the downstream edge of the recording sheet 19 in the downstream end area 91, e.g., a part upstream of the part facing the nozzles 36 in the downstream end area 91, may face the contact portions 83.

When the calculated average value is smaller than or equal to the average threshold value $\alpha 1$ (NO in step S610), the control device 130 may compare a maximum value in the ink amounts of the respective divided areas 93 constituting the downstream end area 91, with a predetermined maximum threshold value $\beta 1$ (step S620). When the maximum value is greater than the maximum threshold value $\beta 1$ (YES in step S620), the control device 130 may also perform the first stop-control (steps S60 in FIG. 9 and step S270 in FIG. 10).

When the maximum value is smaller than or equal to the maximum threshold value $\beta 1$ (NO in step S620), the control device 130 may perform a difference determination (step S630). In the difference determination, when the control device 130 determines that the stop control needs to be performed (YES in step S630), the control device 130 may perform the first stop-control (step S60 in FIG. 9 and step S270 in FIG. 10). In the difference determination, when the control device 130 determines that the stop control need not be be performed (NO in step S630), the control device 130 may perform the conveyance of the recording sheet 19 in the intermittent conveyance (step S70 in FIG. 9 and step S280 in FIG. 10).

Figure 11A:
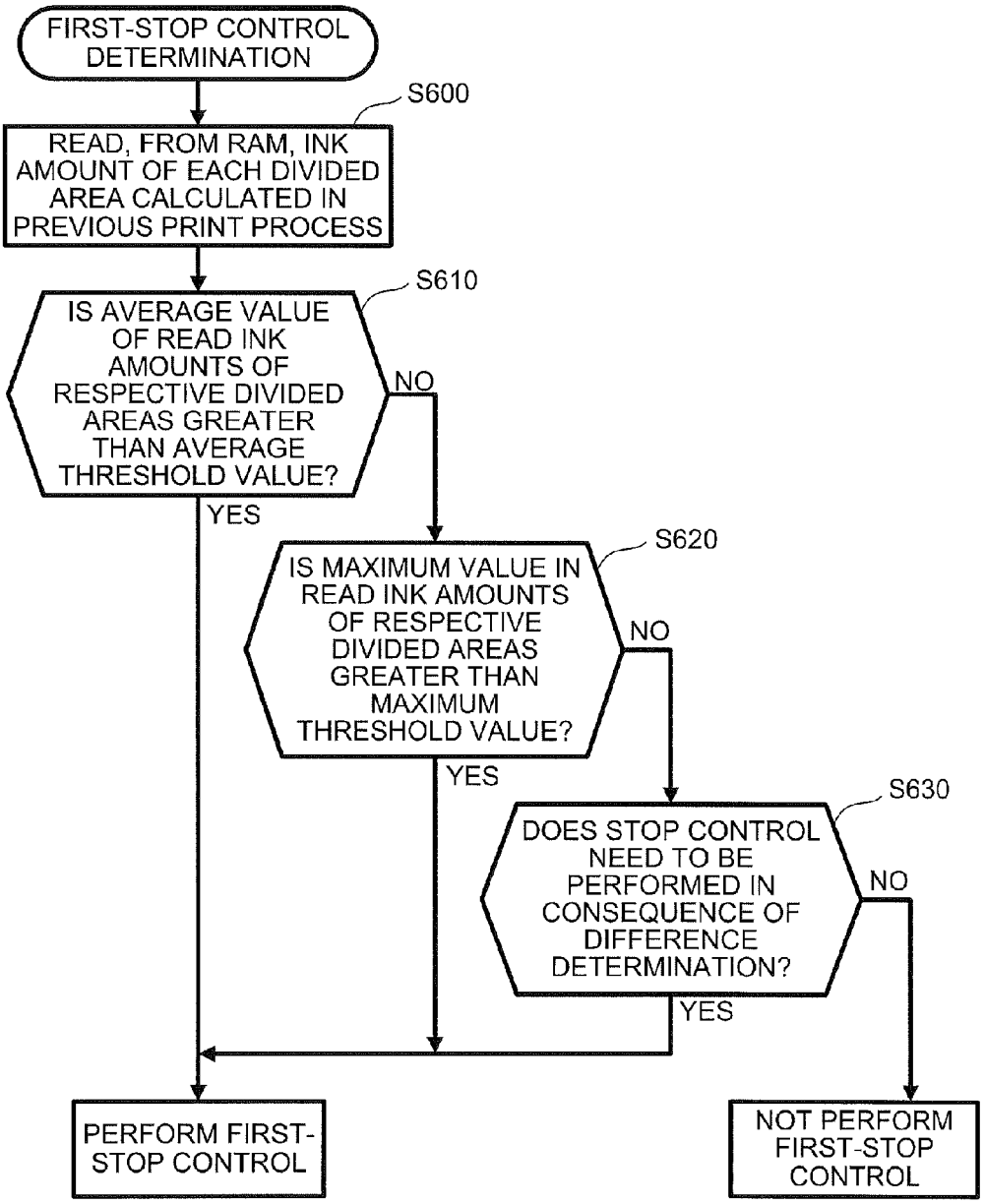
FIG. 11A is a flowchart depicting a first stop-control determination process in the illustrative embodiment according to one or more aspects of the disclosure.
Figure 11B:
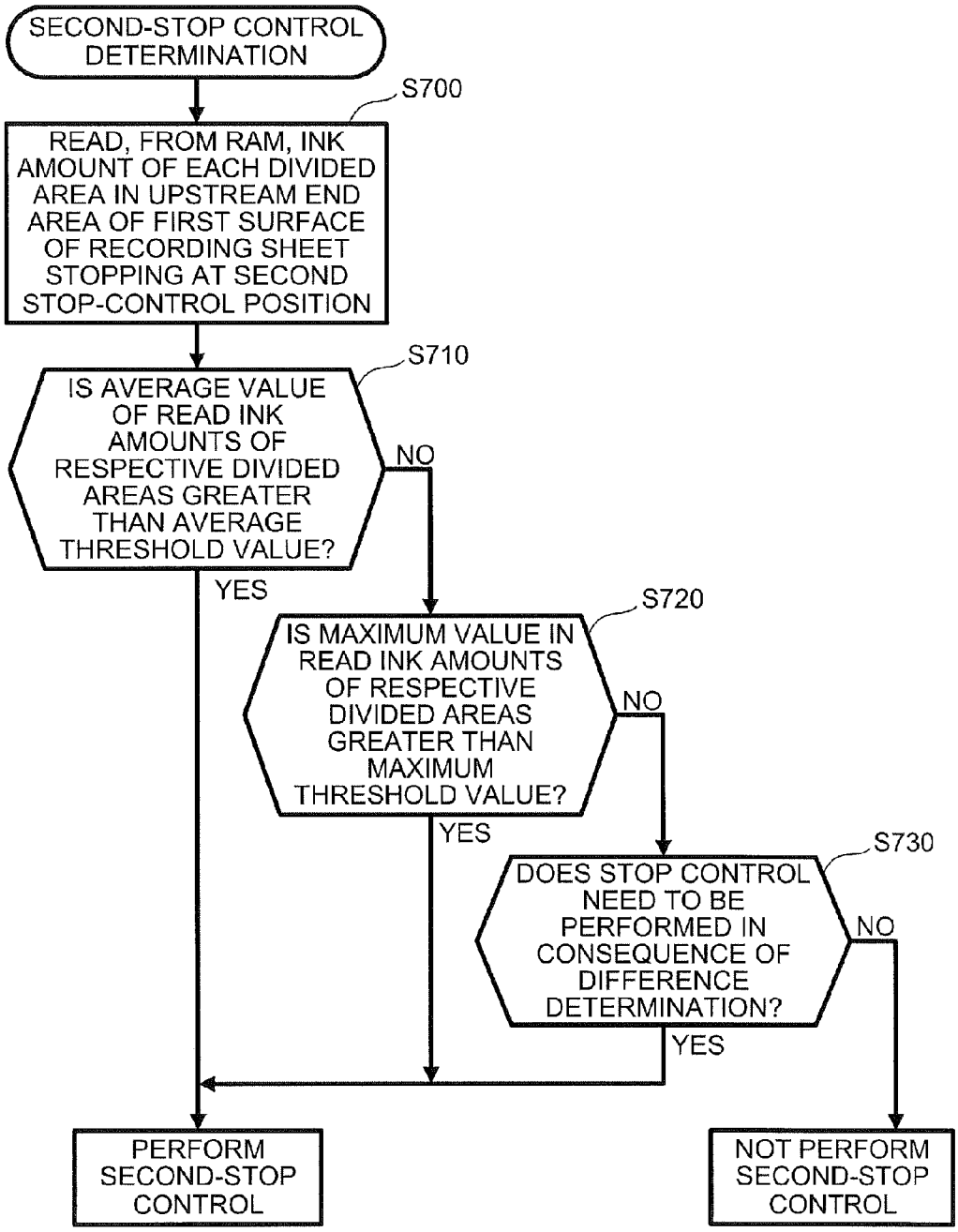
FIG. 11B is a flowchart depicting a second stop-control determination process in the illustrative embodiment according to one or more aspects of the disclosure.
Figure 11C:
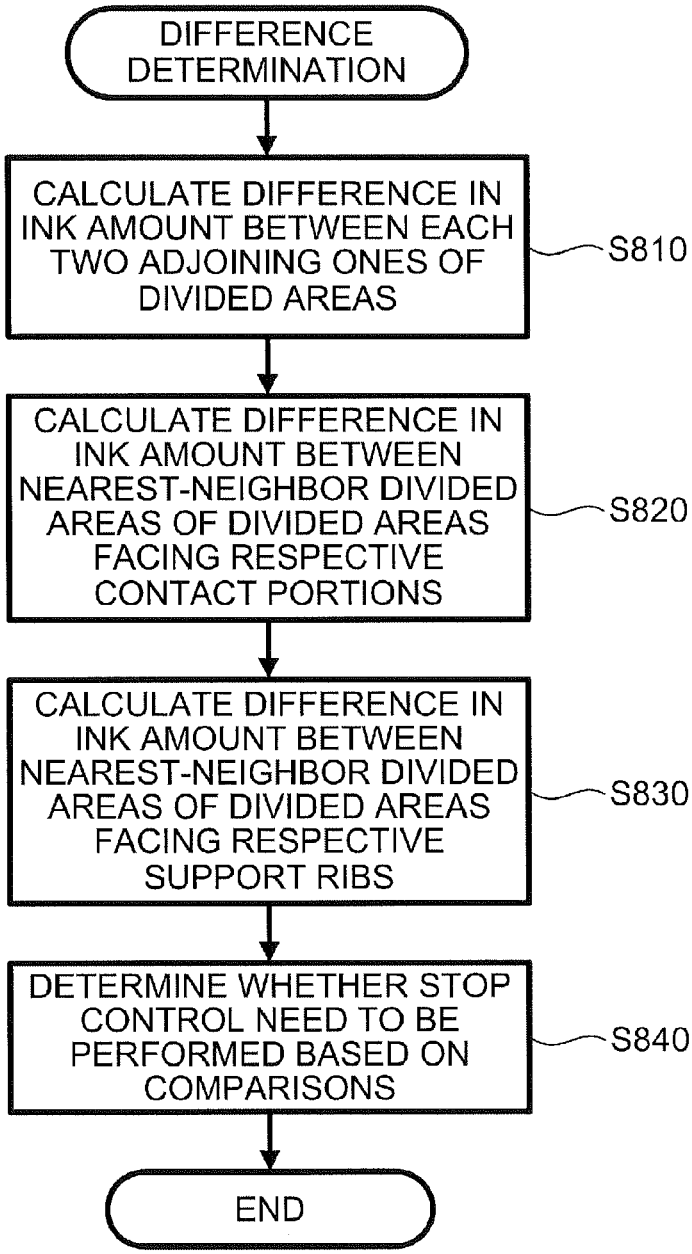
FIG. 11C is a flowchart depicting a difference determination process in the illustrative embodiment according to one or more aspects of the disclosure.

Referring to FIG. 11C, the difference determination process is now described. First, the control device 130 may calculate a difference in ink amount between each two adjoining areas of the divided areas 93 in the downstream end area 91 with respect to the right-left direction 9 (step S810). For example, in FIG. 12A, the control device 130 may calculate a difference in ink amount between the divided area 93E and the right-adjoining divided area 93F and a difference in ink amount between the divided area 93E and the left-adjoining divided area 93D. In the illustrative embodiment, in step S810, in the recording sheet 19 having a shape of alternate ridge portions and groove portions (e.g., a corrugated shape) formed by the contact portions 83 and the support ribs 52, a difference in ink amount between a divided area 93 corresponding to one of the ridge portions and an adjoining divided area 93 corresponding to one of the groove portions may be calculated.

Of all the divided areas 93 constituting the downstream end area 91, for each of the divided areas 93 facing the respective contact portions 83, the control device 130 may calculate a difference in ink amount between each divided area 93 and its nearest-neighbor divided area 93, to the right and a difference in ink amount between each divided area 93 and its nearest-neighbor divided area 93 to the left (step S820). For example, in FIG. 12A, the control device 130 may calculate a difference in ink amount between the divided area 93E and its right nearest-neighbor divided area 93G and a difference in ink amount between the divided area 93E and its left nearest-neighbor divided area 93C.

Of all the divided areas 93 constituting the downstream end area 91, for each of the divided areas 93 facing the respective support ribs 52, the control device 130 may calculate a difference in ink amount between each divided area 93 and its right nearest-neighbor divided area 93 and a difference in ink amount between each divided area 93 and its left nearest-neighbor divided area 93 (step S830). For example, in FIG. 12A, the control device 130 may calculate a difference in ink amount between the divided area 93D and its right nearest-neighbor divided area 93F and a difference between the divided area 93D and its left nearest-neighbor divided area 93B.

In step S840, the control device 130 may compare each difference calculated in step S810 with a predetermined adjoining threshold value γ1, compare each difference calculated in step S820 with a predetermined first neighbor threshold value γ2 (as an example of a neighbor threshold value), and compare each difference calculated in step S830 with a predetermined second neighbor threshold value γ3 (as an example of the neighbor threshold value), and determine whether the stop control needs to be performed.

As a result of the comparison, when all of the differences compared with the adjoining threshold value γ1 are smaller than or equal to the adjoining threshold value γ1, the control device 130 may determine that the stop control need not to be performed (NO in step S630). Thus, the control device 130 may perform the conveyance of the recording sheet 19 in the intermittent conveyance (step S70 in FIG. 9 and step 5280 in FIG. 10). On the other hand, when at least one of the differences compared with the adjoining threshold value γ1 is greater than the adjoining threshold value γ1, the control device 130 may determine that the stop control needs to be performed (YES in step S630). Thus, the control device 130 may perform the first stop-control (step S60 in FIG. 9 and step S270 in FIG. 10).

In some arrangements, when at least one of the differences compared with the adjoining threshold value γ1 is greater than the adjoining threshold value γ1, as a result of the above comparisons, when at least one of the differences compared with the first neighbor threshold value γ2 is greater than the first neighbor threshold value γ2 or when at least one of the differences compared with the second neighbor threshold value γ3 is greater than the second neighbor threshold value γ3, the control device 130 may determine that the stop control need not to be performed (NO in step S630). Thus, the control device 130 may perform the conveyance of the recording sheet 19 in the intermittent conveyance (step S70 in FIG. 9 and step S280 in FIG. 10).

As described above, the control device 130 may determine whether the conveyance of the recording sheet 19 needs to be stopped in a state where the downstream end area 91 faces the nozzles 36 and the contact portions 83, based on the amount of ink ejected onto the downstream end areas 91 of the first and second surfaces, respectively, of the recording sheet 19 with respect to the conveyance direction 16.

The first stop-control performed in each step S130 and S340, e.g., the first stop-control determination for the upstream end areas 92 of the first and second surfaces, respectively, of the recording sheet 19 with respect to the conveyance direction 16 is now described. The control device 130 may read the ink amount of each divided areas 93 from the RAM 133 (step S600), wherein the ink amounts has been calculated for each divided area 93 and stored in the RAM 133 in the previous step (e.g., the print process in which an image is recorded on the upstream end areas 92 of the recording sheet 19 in step S120 or S330) (step S600).

The control device 130 may calculate an average value of the read ink amounts of the respective divided areas 93 constituting the upstream end area 92. Then, the control device 130 may compare the calculated average value with the predetermined average threshold value α1 (step S610). When the calculated average value is greater than the average threshold value α1 (YES in step S610), the control device 130 may perform the first stop-control (step S140 in FIG. 9 and step S350 in FIG. 10).

Figure 7C:
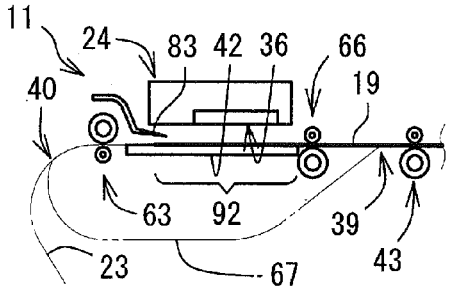
Figure 7D:
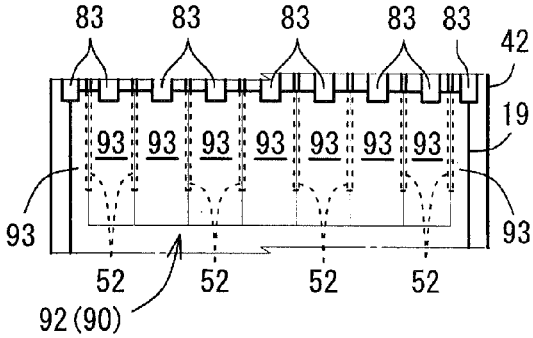

In the first stop-control in steps S130 and S340, the conveyance of the recording sheet 19 may be stopped by the control device 130 in a state where the upstream end area 92 of the recording sheet 19 may face the nozzles 36 and the contact portions 83, as depicted in FIGS. 7C and 7D. For example, an area including the upstream edge of the recording sheet 19 in the upstream end area 92 may face the nozzles 36 and an area not including the upstream edge of the recording sheet 19 in the upstream end area 92, e.g., a part downstream of the part facing the contact portions 83 in the upstream end area 92, may face the nozzles 36.

When the calculated average value is smaller than or equal to the average threshold value α1 (NO in step S610), the control device 130 may compare a maximum value in the ink amounts of the respective divided areas 93 constituting the upstream end area 92, with the predetermined maximum threshold value β1 (step S620). When the maximum value is greater than the maximum threshold value β1 (YES in step S620), the control device 130 may perform the first stop-control (steps S140 in FIG. 9 and step S350 in FIG. 10).

When the maximum value is smaller than or equal to the maximum threshold value β1 (NO in step S620), the control device 130 may perform the above-described difference determination (S630). The difference determination performed in the first stop-control determination in steps S130 and S340 may be different from the above-described difference determination in the following point. For example, in step S630, the control device 130 may calculate a difference in ink amount between each two adjoining ones of the divided areas 93 in the upstream end area 92, but not the divided areas 93 in the downstream end area 91, and compare the calculated differences with the threshold values, respectively, to determine whether the stop control needs to be performed.

When the control device 130 determines that the stop control needs to be performed (YES in step S630), the control device 130 may perform the first stop-control (step S140 in FIG. 9 and step S350 in FIG. 10). When the control device 130 determines that the stop control need not to be performed (NO in step S630), the control device 130 may perform the conveyance of the recording sheet 19 in the intermittent conveyance (step S140 in FIG. 9 and step S350 in FIG. 10).

As described above, the control device 130 may determine whether the conveyance of the recording sheet 19 needs to be stopped in a state where the upstream end area 92 faces the nozzles 36 and the contact portions 83, based on the amount of ink ejected onto the upstream end area 92 of the first and second surfaces, respectively, of the recording sheet 19 with respect to the conveyance direction 16.

Referring to FIGS. 7E, 7F, 10, and 11B, the second stop-control determination process is now described.

In the second stop-control determination, processing of steps S700-S730 may be performed in step S200 in FIG. 10.

Figure 7E:
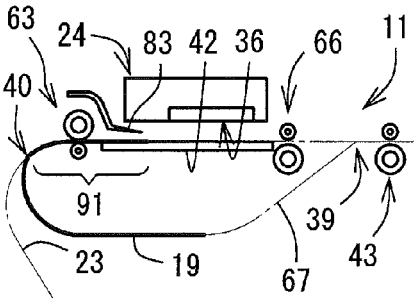

As depicted in FIG. 7E, when the recording sheet 19 is stopped at the second stop-control position, the contact portions 83 may face the downstream end area 91 (more specifically, a downstream-edge side part of the downstream end area 91) of the second surface of the recording sheet 19. Under this condition, the control device 130 may read the ink amount of each divided area 93 opposite to the downstream end area 91 of the second surface, e.g., the ink amount of each divided area 93 in the upstream end area 92 of the first surface of the recording sheet 19 (step S700).

The control device 130 may calculate an average value of the read ink amounts of the respective divided areas 93 constituting the downstream end area 91 of the second surface of the recording sheet 19. Then, the control device 130 may compare the calculated average value with a predetermined average threshold value $\alpha 2$ (step S710). When the calculated average value is greater than the average threshold value $\alpha 2$ (YES in step S710), the control device 130 may perform the processing of steps S210-S230.

Figure 7F:
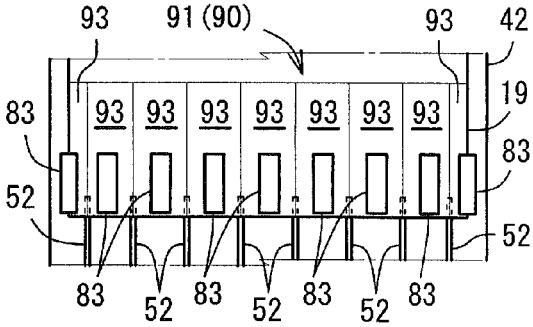
Figure 7G:
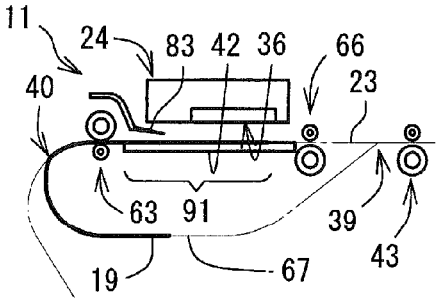
Figure 7H:
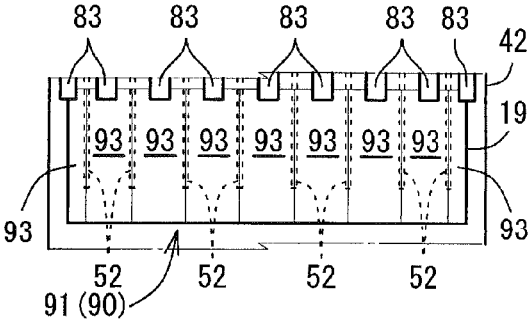

In step 5210, the control device 130 may convey the recording sheet 19 in the conveyance direction 16 until the downstream edge of the recording sheet 19 with respect to the conveyance direction 16 reaches the second stop-control position. Then, in step S220, the control device 130 may perform a second stop-control. The second stop-control may be performed by the control device 130 to stop the conveyance of the recording sheet 19 for a predetermined time period. In the second stop-control, as depicted in FIGS. 7E and 7F, the conveyance of the recording sheet 19 may be stopped by the control device 130 in a state where the downstream end area 91 of the recording sheet 19 may face the contact portions 83. In step S230, the control device 130 may calculate a distance from the second stop-control position to the print start position along the conveyance path 23. Then, in step S240, the control device 130 may convey the recording sheet 19 by the distance calculated in step 5230.

When the average value calculated in step S710 is smaller than or equal to the average threshold value $\alpha 2$ (NO in step S710), the control device 130 may compare a maximum value in the ink amounts of the respective divided areas 93 constituting the downstream end area 91, with a predetermined maximum threshold value $\beta 2$ (step S720). When the maximum value is greater than the maximum threshold value $\beta 2$ (YES in step S720), the control device 130 may perform the above-described processing of the steps S210-S230.

When the maximum value is smaller than or equal to the maximum threshold value $\beta 2$ (NO in step S720), the control device 130 may perform a difference determination (step S730). In the difference determination performed in step S730, the same processing as the processing performed in the difference determination of the first stop-control determination in steps S50 and S260 may be performed.

In the difference determination, when the control device 130 determines that the stop control needs to be performed (YES in step S730), the control device 130 may perform the processing of steps S210-S230. In the difference determination, when the control device 130 determines that the stop control need not be performed (NO in step S730), the control device 130 may perform the conveyance of the recording sheet 19 in the intermittent conveyance (step S240 in FIG. 10).

As described above, the control device 130 may determine whether the conveyance of the recording sheet 19 that an image is to be recorded on its second surface while the recording sheet 19 is conveyed in the main conveyance path 23 from the reverse conveyance path 67 via the second position 40 needs to be stopped in a state where the downstream edge of the recording sheet 19 with respect to the conveyance direction 16 faces the contact portions 83, based on the amount of ink ejected onto the upstream end area 92 of the first surface of the recording sheet 19 that an image has been recorded on the first surface while the recording sheet was conveyed in the main conveyance path 23 from the sheet feed tray 20.

According to the illustrative embodiment, a recording sheet 19 that an image has been recorded on its first surface conveyed from the sheet feed tray 20 into the main conveyance path 23 may be conveyed through the reverse conveyance path 67 from the first position 39 toward the second position 40 by the reverse roller pair 43 while an upstream edge of the recording sheet 19 with respect to the conveyance direction 16 when the image is recorded on the first surface thereof is regarded as a leading edge. Then, the recording sheet 19 may be conveyed again to the position where the recording sheet 19 may face the recording portion 24 through the main conveyance path 23. Subsequently, an image may be recorded on a second surface of the recording sheet 19 by which ink droplets are ejected from the nozzles 36 while the recording sheet 19 faces the recording portion 24 again. The downstream edge and upstream edge of the recording sheet 19 may be reversed to each other with respect to the conveyance direction 16 between when an image is recorded on the second surface of the recording sheet 19 and when an image is recorded on the first surface of the recording sheet 19. For example, the downstream edge of the recording sheet 19 with respect to the conveyance direction 16 when an image is recorded on the second surface of the recording sheet 19 may be the upstream edge of the recording sheet 19 with respect to the conveyance direction 16 when an image is recorded on the first surface of the recording sheet 19.

In the illustrative embodiment, for example, when a large amount of ink has been ejected onto the upstream end area 92 of the first surface of the recording sheet 19 with respect to the conveyance direction 16 at the time the recording sheet 19 is conveyed into the main conveyance path 23 again from the reverse conveyance path 67 via the second position 40, the conveyance of the recording sheet 19 may be stopped in a state where the downstream end area 91 (i.e., the opposite side to the upstream end area 92 on which a large amount of ink have been ejected) of the recording sheet 19 may be in contact with the contact portions 83. In this state, the downstream end area 91 of the recording sheet 19 with respect to the conveyance direction 16 may be formed in a corrugated shape along the right-left direction 9 by which the recording sheet 19 is pressed by the contact portions 83 while being supported by the support ribs 52. The corrugated shape formed in the recording sheet 19 may relieve the deformation of the downstream end area 91 of the recording sheet 19 with respect to the conveyance direction 16 caused by adhesion of the large amount of ink onto the recording sheet 19. Thus, an occurrence of a paper jam caused by the deformation of the recording sheet 19 due to the penetration of ink droplets into the recording sheet 19 may be reduced.

According to the illustrative embodiment, when a large amount of ink droplets has been ejected onto the downstream end area 91 of the recording sheet 19 with respect to the conveyance direction 16, the conveyance of the recording sheet 19 may be stopped while the recording sheet 19 is pressed by the contact portions 83 immediately upstream of the downstream end area 91. Thus, the recording sheet 19 may become a corrugated shape along the right-left direction 9. As a result, the deformation of the downstream end area 91 due to the penetration of the large amount of ink droplets into the recording sheet 19 may be relieved.

According to the illustrative embodiment, when a large amount of ink droplets has been ejected onto the downstream end area 91 of the recording sheet 19 with respect to the conveyance direction 16, the conveyance of the recording sheet 19 may be stopped while the recording sheet 19 is pressed by the contact portions 83 immediately upstream of the upstream end area 92. Thus, the recording sheet 19 may become a corrugated shape along the right-left direction 9. As a result, the deformation of the upstream end area 92 due to the penetration of the large amount of ink droplets into the recording sheet 19 may be relieved.

When a large amount of ink droplets has been uniformly ejected onto the end area 90 of the recording sheet 19 with respect to the conveyance direction 16, the recording sheet 19 may tend to be deformed in the end area 90. According to the illustrative embodiment, in the above case, the conveyance of the recording sheet 19 may be stopped while the recording sheet 19 is pressed by the contact portions 83 immediately upstream of the end area 90. Thus, the recording sheet 19 may be formed in a corrugated shape along the right-left direction 9. As a result, the deformation of the end area 90 may be relieved.

When a large amount of ink droplets has been ejected onto a part of the end area 90 of the recording sheet 19 intensively with respect to the conveyance direction 16, the recording sheet 19 may tend to be deformed in the part where the large amount of ink droplets penetrates. According to the illustrative embodiment, in the above case, the conveyance of the recording sheet 19 may be stopped while the recording sheet 19 is pressed by the contact portions 83 immediately upstream of the end area 90 including the part where the large amount of ink droplets penetrates. Thus, the recording sheet 19 may be formed in a corrugated shape along the right-left direction 9. As a result, the deformation of the end area 90 including the part where the large amount of ink droplets penetrates may be relieved.

When a difference in ink amount between adjoining divided areas 93 of the end area 90 of the recording sheet 19 with respect to the conveyance direction 16 is greater than the threshold value, the recording sheet 19 may tend to be deformed at the boundary between the adjoining divided areas 93. According to the illustrative embodiment, in the above case, the conveyance of the recording sheet 19 may be stopped while the recording sheet 19 is pressed by the contact portions 83 immediately upstream of the end area 90 including the boundary. Thus, the recording sheet 19 may be formed in a corrugated shape along the right-left direction 9. As a result, the deformation of the end area 90 including the boundary may be relieved.

If the recording sheet 19 is formed in a corrugated shape along the right-left direction 9 by which the conveyance of the recording sheet 19 is stopped when a difference in ink amount between nearest-neighbors of the divided areas 93 including positions facing the contact portions 83 is greater than the threshold value, a degree of a ridge portion formed in the recording sheet 19 may become greater in one of the nearest-neighbor divided areas 93 in which the difference in ink amount therebetween is greater than the threshold value. Then, the greater ridge portion may cause deformation in the recording sheet 19. Therefore, in the above-described illustrative embodiment, when the difference is greater than the threshold value, the conveyance of the recording sheet 19 may not be stopped. Thus, the deformation of the recording sheet 19 caused by the corrugation formed in the recording sheet 19 may be reduced.

Figure 12B:
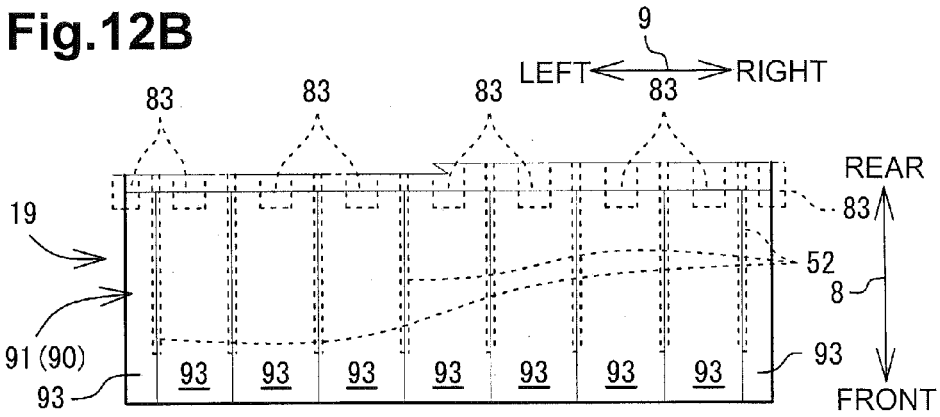
Figure 12C:
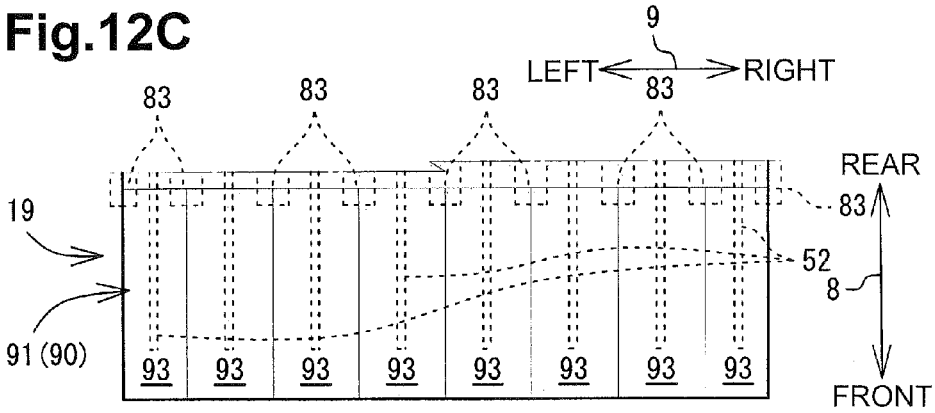

In the illustrative embodiment, the end part 90 may be divided into the divided areas 93 that may be smaller than the divided areas 93 depicted in FIGS. 12B and 12C. With this configuration, the deformation of the recording sheet 19 may be precisely relieved.

Figure 13:
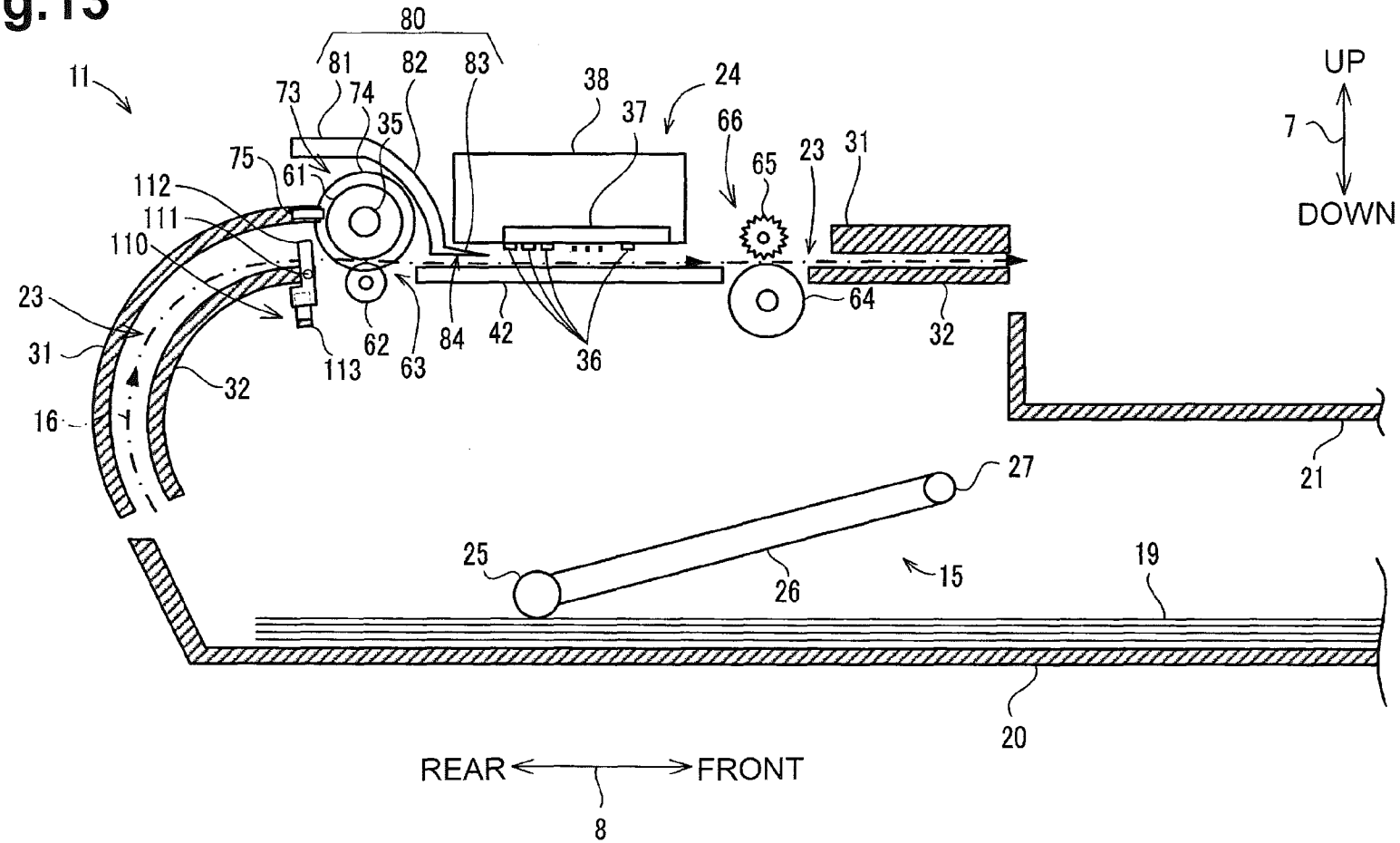
FIG. 13 is a schematic longitudinal sectional view depicting an internal configuration of another printer portion in a first variation of the illustrative embodiment according to one or more aspects of the disclosure.

In the above-described illustrative embodiment, the multifunction peripheral 10 may be allowed to perform the double-sided image recording. Nevertheless, in a first variation of the illustrative embodiment, for example, the multifunction peripheral 10 may be allowed to perform a single-sided image recording only, as depicted in FIG. 13. In this case, the multifunction peripheral 10 may not comprise the configuration necessary for the double-sided image recording, such as the path switching member 41, the third guide member 33 and the fourth guide member 34 defining the reverse conveyance path 67, and the reverse roller pair 43.

In the first variation, the processing of steps S170-S370 for the double-sided image recording might not be performed in the flowchart of FIGS. 9 and 10 performed in the above-described illustrative embodiment. In the first variation, the conveyor roller pair 63 may be an example of a conveyor.

According to the first variation, in the multifunction peripheral 10 configured to record an image on only one surface of a recording sheet 19, effects that may be the same as the effects provided by the multifunction peripheral 10 according to the above-described illustrative embodiment may be provided.

In the above-described illustrative embodiment, as depicted in FIG. 12A, the end area 90 may be divided into the plurality of divided areas 93 at boundaries defined at respective positions each of which may face a position between one support rib 52 and one contact portion 83 adjacent to the one support rib 52 with respect to the right-left direction 9. Nevertheless, in a second variation of the illustrative embodiment, for example, as depicted in FIG. 12B, the end area 90 may be divided into a plurality of divided areas 93 at boundaries defined at respective positions facing the respective support ribs 52.

In the second variation, the same processing may be performed in steps S810 and S820 in the flowchart of FIG. 11C according to the above-described illustrative embodiment. Therefore, the processing of step S810 and S820 may be integrated into a single step.

According to the second variation, when the divided area 93 where a large amount of ink droplets penetrates is deformed toward the nozzles 36, the manner of dividing the end area 90 into the plurality of divided area 93 may relieve the deformation of the recording sheet 19 appropriately.

In the above-described illustrative embodiment, as depicted in FIG. 12A, the end area 90 may be divided into a plurality of divided areas 93 at boundaries defined at respective positions each of which may face a position between one support rib 52 and one contact portion 83 adjacent to the one support rib 52 with respect to the right-left direction 9. Nevertheless, in a third variation of the illustrative embodiment, for example, as depicted in FIG. 12C, the end area 90 may be divided into a plurality of divided areas 93 at boundaries defined at respective positions facing the respective contact portions 83.

In the third variation, the same processing may be performed in steps S810 and S830 in the flowchart of FIG. 11C according to the above-described illustrative embodiment. Therefore, the processing of step S810 and S830 may be integrated into a single step.

According to the third variation, when the divided area 93 where a large amount of ink droplets penetrates is deformed to move away from the nozzles 36, the manner of dividing the end area 90 into the plurality of divided area 93 may relieve the deformation of the recording sheet 19 appropriately.

Figure 8A:
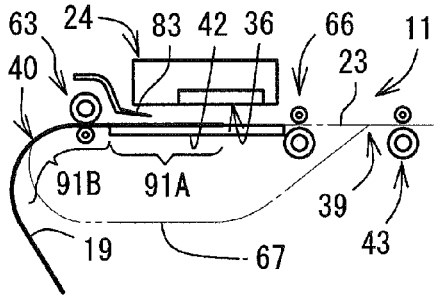
FIGS. 8A, 8C, 8E, and 8G are schematic sectional views depicting the printer portion for explaining a condition of a recording sheet during recording control in a fourth variation of the illustrative embodiment according to one or more aspects of the disclosure.
Figure 8B:
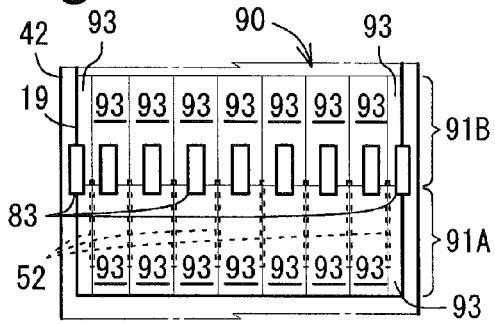
FIGS. 8B, 8D, 8F, and 8H are schematic plan views depicting the recording sheet and the platen during the recording control in FIGS. 8A, 8C, 8E, and 8G, respectively, in the fourth variation of the illustrative embodiment according to one or more aspects of the disclosure.

In the above-described illustrative embodiment, the recording sheet 19 may comprise a single downstream end area 91 and a single upstream end area 92 defined thereon with respect to the conveyance direction 16 as depicted in FIGS. 6, 7B, 7D, 7F, 7H, and 12A. Nevertheless, in a fourth variation of the illustrative embodiment, for example, a plurality of downstream end areas 91 and a plurality of upstream end areas 92 may be defined on the recording sheet 19 with respect to the conveyance direction 16. For example, as depicted in FIGS. 8B and 8D, the downstream end area 91 of the recording sheet 19 may comprise a first downstream end area 91A and a second downstream end area 91B. Further, as depicted in FIGS. 8F and 8H, the upstream end area 92 of the recording sheet 19 may comprise a first upstream end area 92A and a second upstream end area 92B.

In the fourth variation, the first stop-control determination, the second stop-control determination, the first stop-control, and the second stop-control may be performed for each of the downstream end areas 91A, 91B and the upstream end areas 92A, 92B with respect to the conveyance direction 16.

Figure 8C:
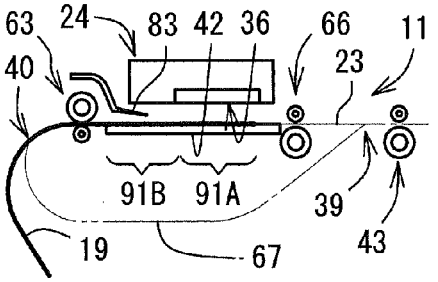
Figure 8D:
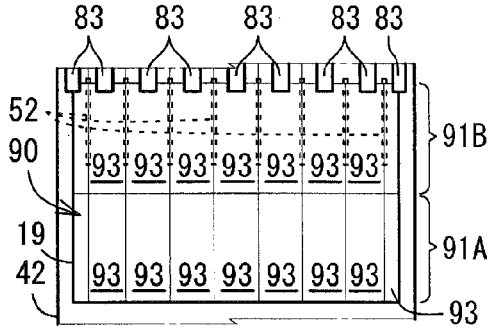
Figure 8E:
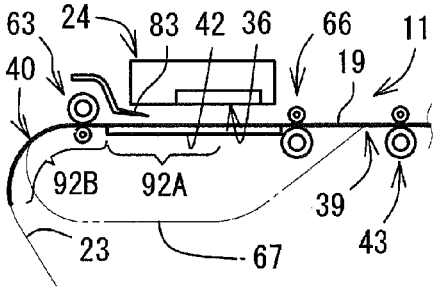
Figure 8F:
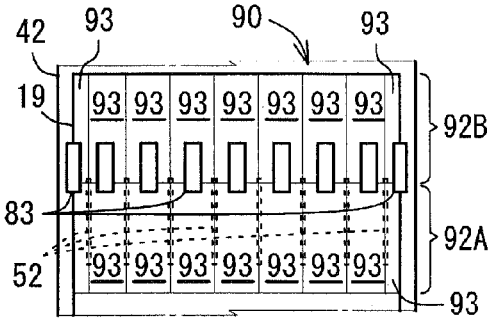
Figure 8G:
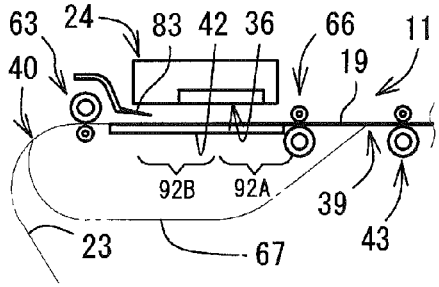
Figure 8H:
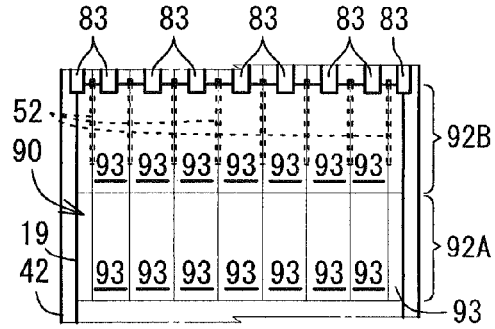

For example, the first stop-control determination in step S50 and the first stop-control in step S60 may be performed in both respective cases of a state where the conveyance of the recording sheet 19 is stopped in a state where the first downstream end area 91A of the recording sheet 19 faces the nozzles 36 and the contact portions 83 (see FIGS. 8A and 8B) and a state where the conveyance of the recording sheet 19 is stopped in a state where the second downstream end area 91B of the recording sheet 19 faces the nozzles 36 and the contact portions 83 (see FIGS. 8C and 8D). Further, for example, the first stop-control determination in step S130 and the first stop-control in step S140 may be performed in both respective cases of a state where the conveyance of the recording sheet 19 is stopped in a state where the first upstream end area 92A of the recording sheet 19 faces the nozzles 36 and the contact portions 83 (see FIGS. 8E and 8F) and a case where the conveyance of the recording sheet 19 is stopped in a state where the second upstream end area 92B of the recording sheet 19 faces the nozzles 36 and the contact portions 83 (FIGS. 8G and 8H).

In the fourth variation, the plurality of downstream end areas 91 and upstream end areas 92 (e.g., the first downstream end area 91A, the second downstream end area 91B, the first upstream end area 92A, and the second upstream end area 92B) defined with respect to the conveyance direction 16 may be an example of a plurality of end areas.

According to the fourth variation, the end area 90 may be divided into a plurality of conveyance-unit areas. Therefore, the deformation of the recording sheet 19 along the conveyance direction 16 may be relieved precisely.

In the above-described illustrative embodiment, all of the processing of steps S610-S630 and steps S710-S730 may be performed. Nevertheless, in a fifth variation of the illustrative embodiment, for example, the processing of one of steps S610-S630 may be performed or the processing of two or more of steps S610-S630 may be combined, and the processing of one of steps S710-S730 may be performed or the processing of two or more of steps S710-S730 may be combined. For example, only the processing of step S610 of steps S610-S630 may be performed and only the processing of step S710 of steps S710-S730 may be performed. In another example, the processing of steps S610 and step S630 of steps S610-S630 may be performed and the processing of steps S710 and S720 of steps S710-S730 may be performed.

In the above-described illustrative embodiment, in step S620, the maximum values in the ink amounts of the respective divided areas 93 constituting the downstream end area 91 and the upstream end area 92 may be compared with the predetermined maximum threshold value β1, respectively. In the above-described illustrative embodiment, in step S720, the maximum value in the ink amounts of the respective divided areas 93 constituting the downstream end area 91 may be compared with the predetermined maximum threshold value β2.

Nevertheless, in a sixth variation of the illustrative embodiment, for example, in step S620, each ink amount of each divided area 93 constituting the downstream end area 91 and the upstream end area 92 may be compared with the maximum threshold value β1. In step S720, each ink amount of each divided area 93 constituting the downstream end area 91 may be compared with the maximum threshold value β2.

When one or more (e.g., any one) of the ink amounts of the respective divided areas 93 is greater than the maximum threshold value β1 (YES in step S620), the first stop-control may be performed. When all of the ink amounts of the respective divided areas 93 are smaller than or equal to the maximum threshold value β1 (NO in step S620), the difference determination (step S630) may be performed.

When one or more (e.g., any one) of the ink amounts of the respective divided areas 93 is greater than the maximum threshold value β2 (YES in step S720), the processing of steps S210-S230 may be performed. When all of the ink amounts of the respective divided areas 93 are smaller than or equal to the maximum threshold value β2 (NO in step S720), the difference determination (step S730) may be performed.

In the above-described illustrative embodiment, a single value may be specified in each of the maximum threshold values β1, β2. Nevertheless, in a seventh variation, the maximum threshold values β1, β2 may be specified for every divided area 93, and the maximum threshold values β1, β2 for the endmost ones of the divided areas 93 with respect to the right-left direction 9 may be smaller than the maximum threshold values β1, β2 for the other divided areas 93.

For example, in FIG. 12A, the maximum threshold values β1, β2 for the endmost divided areas 93A, 93Q with respect to the right-left direction 9 may be specified smaller than the maximum threshold values β1, β2 for the other divided areas 93B-93P.

For example, in FIG. 12C, both edges of the divided areas 93 other than the endmost divided areas 93 with respect to the right-left direction 9 may be allowed to be held by the respective corresponding contact portions 83. On the other hand, both edges of the endmost divided areas 93 with respect to the right-left direction 9 might not be held by the respective contact portions 83 while its one edge located closer to a center of a recording sheet 19 than the other edge with respect to the right-left direction 9 is held by the corresponding contact portion 83. Therefore, both end parts of the recording sheet 19 with respect to the right-left direction 9 may be deformed due to penetration of ink that may be less in amount than ink penetrating in the other part of the recording sheet 19. Therefore, in the seventh variation, the maximum threshold values β1, β2 for the endmost divided areas 93 that may tend to be deformed in the right-left direction 9 may be defined to be smaller than the maximum threshold values β1, β2 for the other divided areas 93. Thus, the deformation of the recording sheet 19 in the end parts thereof with respect to the right-left direction 9 may be relieved.

Although specific examples of carrying out the invention have been described, those skilled in the art will appreciate that there are numerous variations and permutations of the above-described systems and methods that are contained within the spirit and scope of the invention as set forth in the appended claims. Additionally, numerous other embodiments, modifications and variations within the scope and spirit of the appended claims will occur to persons of ordinary skill in the art from a review of this disclosure.

What is claimed is:

1. An inkjet recording apparatus, comprising:

a first conveyor configured to convey a sheet in a conveyance direction;

a support portion comprising a plurality of protrusions spaced apart from each other with respect to a width direction perpendicular to the conveyance direction, wherein the support portion is disposed downstream of the first conveyor with respect to the conveyance direction and configured to support the sheet from below;

a recording portion disposed opposingly above the support portion and configured to record an image onto the sheet supported by the support portion based on print data by ejecting ink droplets from nozzles;

a contact portion disposed between a pair of protrusions of the plurality of protrusions with respect to the width direction and in a manner that the contact portion faces the support portion, wherein the contact portion at least partially overlaps the plurality of protrusions when viewed along the width direction;

a control device; and memory storing instructions that, when executed, cause the control device to:

determine, based on the print data, an amount of ink needed to form at least a portion of an image, corresponding to the print data, on the sheet;

determine whether to stop conveyance of the sheet, in a state where the sheet faces the contact portion, based on the determined amount of ink needed to form the at least a portion of the image; and stop the conveyance of the sheet in response to determining that the conveyance of the sheet is to be stopped.

2. The inkjet recording apparatus to claim 1, wherein the instructions stored in the memory, when executed, cause the control device to determine a number of droplets required to form the at least a portion of the image.

3. The inkjet recording apparatus according to claim 1, wherein the at least a portion of the image is an image to be formed in an end area of the sheet with respect to the conveyance direction, wherein the end area extends from one of: an upstream edge of the sheet and a downstream edge of the sheet in the conveyance direction.

4. The inkjet recording apparatus according to claim 3, further comprising:

a reverse guide portion defining a reverse conveyance path connected to a main conveyance path at a first position defined downstream of the support portion and at a second position defined upstream of the first conveyor with respect to the conveyance direction; and a second conveyor disposed downstream of the first position with respect to the conveyance direction and configured to convey the sheet in the conveyance direction or in a direction toward the reverse conveyance path, wherein the end area is an upstream end area extending from the upstream edge of the sheet, wherein the sheet further includes a downstream end area extending from the downstream edge of the sheet, and wherein the instructions, when executed, cause the control device to determine whether the conveyance of the sheet needs to be stopped in the state where the downstream end area of the sheet with respect to the conveyance direction faces the contact portion, based on the amount of ink needed to form the at least a portion of the image, wherein the at least a portion of the image is an image to be formed in the upstream end area of a second surface of the sheet opposite to a first surface of the sheet.

5. The inkjet recording apparatus according to claim 4, wherein the contact portion is disposed upstream of the nozzles in the conveyance direction, and wherein the instructions, when executed, cause the control device to determine, based on the determined amount of ink needed to form the at least a portion of the image, whether to stop the conveyance of the sheet, in the state where the downstream end area of the first surface of the sheet faces the contact portion, prior to ejecting ink onto the first surface of the sheet and after forming the at least a portion of the image in the upstream end area of the second surface of the sheet.

6. The inkjet recording apparatus according to claim 4, wherein the instructions, when executed, cause the control device to determine whether to stop the conveyance of the sheet in a state where the downstream end area of the second surface of the sheet with respect to the conveyance direction faces the nozzles and the contact portion, based on the amount of ink needed to form the at least a portion of the image, wherein the at least a portion of the image is an image to be formed in the downstream end area of the second surface of the sheet with respect to the conveyance direction.

7. The inkjet recording apparatus according to claim 4, wherein the instructions, when executed, cause the control device to determine whether to stop the conveyance of the sheet in a state where the downstream end area of the first surface of the sheet with respect to the conveyance direction faces the nozzles and the contact portion, based the amount of ink needed to form the at least a portion of the image, wherein the at least a portion of the image is an image to be formed in the downstream end area of the first surface of the sheet with respect to the conveyance direction.

8. The inkjet recording apparatus according to claim 4, wherein the instructions, when executed, cause the control device to determine whether to stop the conveyance of the sheet in a state where the upstream end area of the second surface of the sheet with respect to the conveyance direction faces the nozzles and the contact portion, based on the amount of ink needed to form the at least a portion of the image, wherein the at least a portion of the image is an image to be formed in the upstream end area of the second surface of the sheet with respect to the conveyance direction.

9. The inkjet recording apparatus according to claim 4, wherein the instructions, when executed, cause the control device to determine whether to stop the conveyance of the sheet in a state where the upstream end area of the first surface of the sheet with respect to the conveyance direction faces the nozzles and the contact portion, based on the amount of ink needed to form the at least a portion of the image, wherein the at least a portion of the image is an image to be formed in the upstream end area of the first surface of the sheet with respect to the conveyance direction.

10. The inkjet recording apparatus according to claim 3, wherein the end area is an upstream end area extending from the upstream edge of the sheet, wherein the sheet further includes a downstream end area extending from the downstream edge of the sheet, and wherein the instructions, when executed, cause the control device to determine whether to stop the conveyance of the sheet in a state where a downstream end area of one surface of the sheet with respect to the conveyance direction faces the nozzles and the contact portion, based on the amount of ink needed to form the at least a portion of the image, wherein the at least a portion of the image is an image to be formed in the downstream end area of the one surface of the sheet.

11. The inkjet recording apparatus according to claim 10, wherein the instructions, when executed, cause the control device to determine whether to stop the conveyance of the sheet in a state where the upstream end area of the one surface of the sheet with respect to the conveyance direction faces the nozzles and the contact portion, based on the amount of ink needed to form the at least a portion of the image, wherein the at least a portion of the image is an image to be formed in the upstream end area of the one surface of the sheet with respect to the conveyance direction.

12. The inkjet recording apparatus according to claim 10, wherein the contact portion is disposed upstream of the nozzles in the conveyance direction.

13. The inkjet recording apparatus according to claim 1, wherein the sheet includes an end area extending from one of: an upstream edge of the sheet and a downstream edge of the sheet in the conveyance direction, wherein the end area of the sheet is divided into a plurality of divided areas in the width direction, and wherein the instructions, when executed, cause the control device to determine whether to stop the conveyance of the sheet based on a respective amount of ink needed to form a respective image in each of the plurality of divided areas.

14. The inkjet recording apparatus according to claim 13, wherein the instructions, when executed, cause the control device to determine to stop the conveyance of the sheet in response to determining that an average of the amounts of ink needed to form the images in the plurality of divided areas of the end area is greater than an average threshold value.

15. The inkjet recording apparatus according to claim 13, wherein the instructions, when executed, cause the control device to determine to stop the conveyance of the sheet in response to determining that one of the amounts of ink needed is greater than a maximum threshold value.

16. The inkjet recording apparatus according to claim 15, wherein a respective maximum threshold value is specified for each of the plurality of divided areas, and each of the respective maximum threshold values for a first endmost divided area and a second endmost divided area, in the width direction, is smaller than the maximum threshold value for at least one divided area disposed between, in the width direction, the first and second endmost divided areas.

17. The inkjet recording apparatus according to claim 13, wherein the instructions, when executed, cause the control device to determine to stop the conveyance of the sheet in response to determining that a difference in the amounts of ink needed for two adjoining divided areas of the plurality of divided areas is greater than an adjoining threshold value.

18. The inkjet recording apparatus according to claim 17, wherein the inkjet recording apparatus comprises a plurality of contact portions disposed upstream of the nozzles with respect to the conveyance direction, wherein each of the plurality of contact portions disposed upstream of the nozzles is disposed between a different pair of protrusions of the plurality of protrusions with respect to the width direction, and wherein the instructions, when executed, cause the control device to determine not to stop the conveyance of the sheet in response to determining that:

a difference in the amounts of ink needed for a divided area and a closest other divided area facing a respective contact portion is greater than a neighbor threshold value, or a difference in the amounts of ink needed for a divided area and a closest other divided area facing a respective protrusion is greater than the neighbor threshold value.

19. The inkjet recording apparatus according to claim 13, wherein one or more of the plurality of protrusions are disposed at a boundary between the plurality of divided areas.

20. The inkjet recording apparatus according to claim 13, wherein the contact portion is disposed at a boundary between the plurality of divided areas.

21. The inkjet recording apparatus according to claim 13, wherein the end area is divided into the plurality of divided areas with at least one boundary between the plurality of divided areas defined at a position between one of the plurality of protrusions and the contact portion with respect to the width direction.

22. The inkjet recording apparatus according to claim 1, wherein the sheet includes an end area extending from one of: an upstream edge of the sheet and a downstream edge of the sheet in the conveyance direction, wherein the sheet is divided into a plurality of divided areas in the conveying direction, and wherein the instructions, when executed, cause the control device to determine whether to stop the conveyance of the sheet for each of the plurality of divided areas.

23. The inkjet recording apparatus according to claim 1, wherein a lowest end of the contact portion is located lower than highest ends of the plurality of protrusions.

24. An inkjet recording apparatus, comprising:

a conveyor configured to convey a sheet in a conveyance direction along a conveyance path;

a support portion is disposed downstream of the conveyor with respect to the conveyance direction and configured to support from below the sheet being conveyed in the conveyance path;

a recording portion disposed opposingly above the support portion and configured to record an image onto the sheet supported by the support portion based on print data by ejecting ink droplets from nozzles;

a corrugate mechanism configured to form a corrugated shape in the sheet;

a control device; and memory storing instructions that, when executed, cause the control device to:

determine, based on the print data, an amount of ink needed to form at least a portion of an image, corresponding to the print data, on the sheet;

determine whether to stop conveyance of the sheet, in a state where the sheet faces the corrugate mechanism, based on the determined amount of ink needed to form the at least a portion of the image; and stop the conveyance of the sheet in response to determining that the conveyance of the sheet is to be stopped.

25. The inkjet recording apparatus according to claim 24, wherein the corrugate mechanism includes a contact member comprising:

a fixing portion configured to be fixed to the inkjet recording apparatus;

a curved portion extending downwardly and in the conveyance direction from the fixing portion; and a contact portion extending from the curved portion in the conveyance direction, the contact portion configured to contact the sheet.

26. An inkjet recording apparatus, comprising:

a first conveyor configured to convey a sheet in a conveyance direction;

a support portion comprising a plurality of protrusions spaced apart from each other with respect to a width direction perpendicular to the conveyance direction, wherein the support portion is disposed downstream of the first conveyor with respect to the conveyance direction and configured to support the sheet from below;

a recording portion disposed opposingly above the support portion and configured to record an image onto the sheet supported by the support portion based on print data by ejecting ink droplets from nozzles;

a contact portion disposed between a pair of protrusions of the plurality of protrusions with respect to a width direction and in a manner that the contact portion faces the support portion, wherein the contact portion at least partially overlaps the plurality of protrusions when viewed along the width direction;

a control device; and memory storing instructions that, when executed, cause the control device to:

determine whether to stop conveyance of the sheet, in a state where the sheet faces the contact portion, based on the image to be recorded corresponding to the print data; and stop the conveyance of the sheet in response to determining that the conveyance of the sheet is to be stopped.

* * * * *